US007565887B2

(12) United States Patent
Tsuruta et al.

(10) Patent No.: US 7,565,887 B2
(45) Date of Patent: Jul. 28, 2009

(54) VALVE ACTUATION DEVICE OF INTERNAL COMBUSTION ENGINE

(75) Inventors: Seiji Tsuruta, Kanagawa (JP); Mikihiro Kajiura, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 292 days.

(21) Appl. No.: 11/446,138

(22) Filed: Jun. 5, 2006

(65) Prior Publication Data

US 2006/0283412 A1 Dec. 21, 2006

(30) Foreign Application Priority Data

Jun. 20, 2005 (JP) ..... 2005-178955
Apr. 28, 2006 (JP) ..... 2006-124956

(51) Int. Cl.
*F01L 1/34* (2006.01)

(52) U.S. Cl. ..... 123/90.16; 123/90.39; 123/90.44; 74/569

(58) Field of Classification Search ..... 123/90.16, 123/90.39, 90.44, 90.15, 90.17, 90.18, 90.2, 123/90.23, 90.26, 90.6, 90.11; 74/559, 567, 74/569

See application file for complete search history.

(56) References Cited

U.S. PATENT DOCUMENTS 4,762,096 A * 8/1988 Kamm et al. ..... 123/90.16
5,301,636 A * 4/1994 Nakamura ..... 123/90.16

FOREIGN PATENT DOCUMENTS

JP 5-171909 A 7/1993

* cited by examiner

*Primary Examiner*—Ching Chang
(74) *Attorney, Agent, or Firm*—Foley & Lardner LLP

(57) ABSTRACT

For an internal combustion engine, there is provided a valve actuation device which comprises a cam shaft having thereon at least first and second cams that are different in profile; a first rocker arm that is in contact with the first cam to be swung, the first rocker arm being adapted to actuate an engine valve; a second rocker arm that is in contact with the second cam to be swung; a coupling mechanism that selectively couples and uncouples the first and second rocker arms; and an electric actuating mechanism that actuates the coupling mechanism with an electric power for the selective coupling and uncoupling.

19 Claims, 16 Drawing Sheets

VALVE ACTUATION DEVICE OF INTERNAL COMBUSTION ENGINE

BACKGROUND OF THE INVENTION

1. Field of the Invention

The present invention relates in general to valve actuation devices of an internal combustion engine, and more particularly to the valve actuation devices of a valve lift switching type that switches a valve lift characteristic of intake and/or exhaust valves in accordance with an operation condition of the engine.

2. Description of the Related Art

Hitherto, for achieving a reduced fuel consumption in a low and middle speed operation and an improved output torque in a high speed operation, various valve actuation devices have been proposed and put into practical use in the field of internal combustion engines for wheeled motor vehicles. Some of them are of a valve lift switching type that switches the valve lift characteristic of intake and/or exhaust valves in accordance with an operation condition of the engine.

In order to clarify the task of the present invention, one known valve actuation device of such type will be briefly described before describing the detail of the invention, which is shown in Japanese Laid-open Patent Application (Tokkaihei) 5-171909.

In the valve actuation device of the publication, a lower speed rocker arm having one end contactable with an intake valve is pivotally held by a lower speed rocker shaft and a higher speed rocker arm is arranged beside the lower speed rocker arm and pivotally held by a higher speed rocker shaft. Lower and higher speed cams are in contact with the lower and higher speed rocker arms respectively. The higher speed cam is so shaped as to cause the intake valve to have a higher lift degree and a greater working angle than those caused by the lower speed cam.

A hydraulically actuated coupling mechanism is incorporated with the lower and higher speed rocker arms to selectively couple and uncouple the same.

Under operation of the engine, a control unit controls or actuates the coupling mechanism with a hydraulic power in accordance with an operation condition of the engine. That is, when the engine is subjected to a lower speed operation, the controller controls the coupling mechanism to uncouple the two rocker arms thereby activating the lower speed rocker arm and thus causing the intake valve to have a lower lift degree suitable for the lower speed operation. While, when the engine is subjected to a higher speed operation, the controller controls the coupling mechanism to couple the two rocker arms thereby activating the higher speed rocker arm and thus causing the intake valve to have a higher lift degree suitable for the higher speed operation. More specifically, in the lower speed operation, the intake valve lift degree is controlled relatively small and the valve close timing of the intake valve is made before the bottom dead center (BDC) of the piston, so that undesired pumping loss and mechanical friction are reduced and thus the fuel consumption of the engine is improved. While, in the higher speed operation, the intake valve lift degree is controlled relatively large and the valve open timing of the intake valve is advanced, so that intake air charging is increased and thus satisfied output power of the engine is obtained.

SUMMARY OF THE INVENTION

In the above-mentioned valve actuation device, the ON/OFF switching of the coupling mechanism is actuated by a hydraulic pressure produced by an oil pump driven by the engine. Thus, if, like in the condition just after starting of the engine, the hydraulic pressure produced by the oil pump does not have a satisfied power, the ON/OFF switching of the coupling mechanism is not smoothly made and thus the switching between the lower and higher speed rocker arms is not smoothly made. Of course, this phenomenon causes a lowering of the engine performance.

It is therefore an object of the present invention to provide a valve actuation device of an internal combustion engine, which is free of the above-mentioned drawback.

In accordance with the present invention, there is provided a valve actuation device of an internal combustion engine, which can assuredly carries out the ON/OFF switching of the coupling mechanism with an electric power.

In accordance with a first aspect of the present invention, there is provided a valve actuation device of an internal combustion engine, which comprises a cam shaft having thereon at least first and second cams that are different in profile; a first rocker arm that is in contact with the first cam to be swung, the first rocker arm being adapted to actuate an engine valve; a second rocker arm that is in contact with the second cam to be swung; a coupling mechanism that selectively couples and uncouples the first and second rocker arms; and an electric actuating mechanism that actuates the coupling mechanism with an electric power for the selective coupling and uncoupling.

In accordance with a second aspect of the present invention, there is provided a valve actuation device of an internal combustion engine. The engine has two intake valves for each cylinder. The valve actuation device comprises a cam shaft having thereon two first cams and a second cam that is different in profile from the two first cams; a first rocker arm provided with two arm portions that are in contact with the two first cams to induce a swing movement of the first rocker arm, the two arm portions being adapted to actuate the two intake valves respectively; a second rocker arm that is pivotally held by the first rocker arm and in contact with the second cam to be swung; a coupling mechanism that selectively takes an ON condition wherein the first and second rocker arms are coupled and an OFF condition wherein the first and second rocker arms are uncoupled; and an electric actuating mechanism that actuates the coupling mechanism with an electric power to include the ON and OFF conditions of the coupling mechanism selectively.

In accordance with a third aspect of the present invention, there is provided a valve actuation device of an internal combustion engine. The engine has two intake valves for each cylinder. The valve actuating device comprises a rocker shaft; two first rocker arms pivotally held by the rocker shaft and actuating the two intake valves respectively; a second rocker arm pivotally held by the rocker shaft at a position between the two first rocker arms; a coupling mechanism that selectively takes an ON condition wherein the two first rocker arms and the second rocker arm are coupled and an OFF condition wherein the two first rocker arms and the second rocker arm are uncoupled; and an electric actuating mechanism that actuates the coupling mechanism with an electric power to induce the ON and OFF conditions of the coupling mechanism selectively.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

Figure 1:
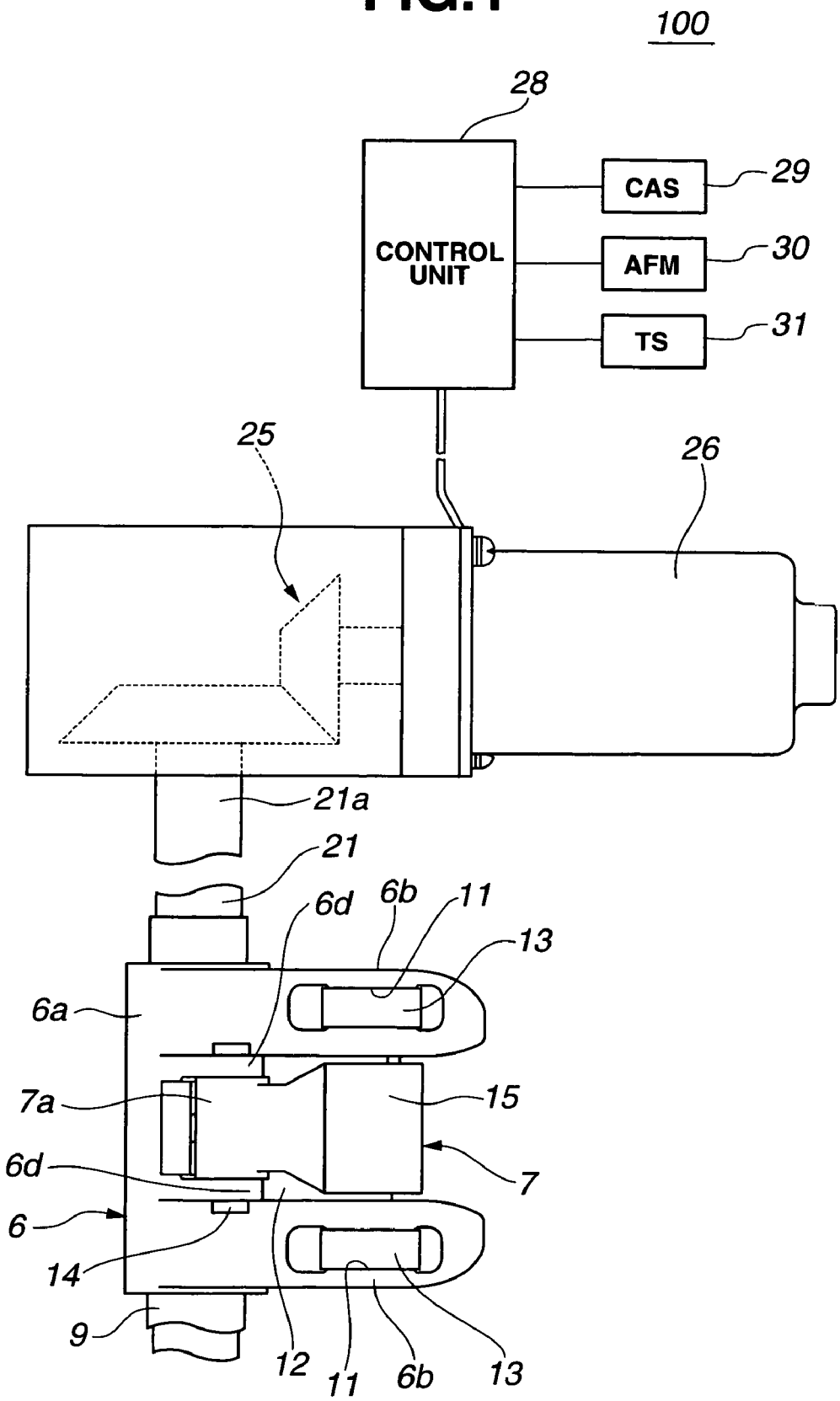
FIG. 1 is a schematic view of a valve actuation device of an internal combustion engine, which is a first embodiment of the present invention.

In the following, various embodiments of the present invention will be described in detail with reference to the accompanying drawings.

For ease of understanding, various directional terms, such as, right, left, upper, lower, rightward and the like are used in the following description. However, these terms are to be understood with respect to only a drawing or drawings on which corresponding element or portion is shown.

Throughout the specification, substantially same elements and portions are denoted by the same reference numerals, and repeated explanation on the same elements or portions will be omitted for simplification of the description.

As will become apparent as the description proceeds, the valve actuation device of the invention that will be described in the following is applied to intake valves of an internal combustion engine. However, the valve actuation device of the invention is applicable to exhaust valves of the internal combustion engine.

Referring to FIGS. 1 to 8 of the drawings, there is shown a valve actuation device 100 of an internal combustion engine, which is a first embodiment of the present invention.

Figure 2:
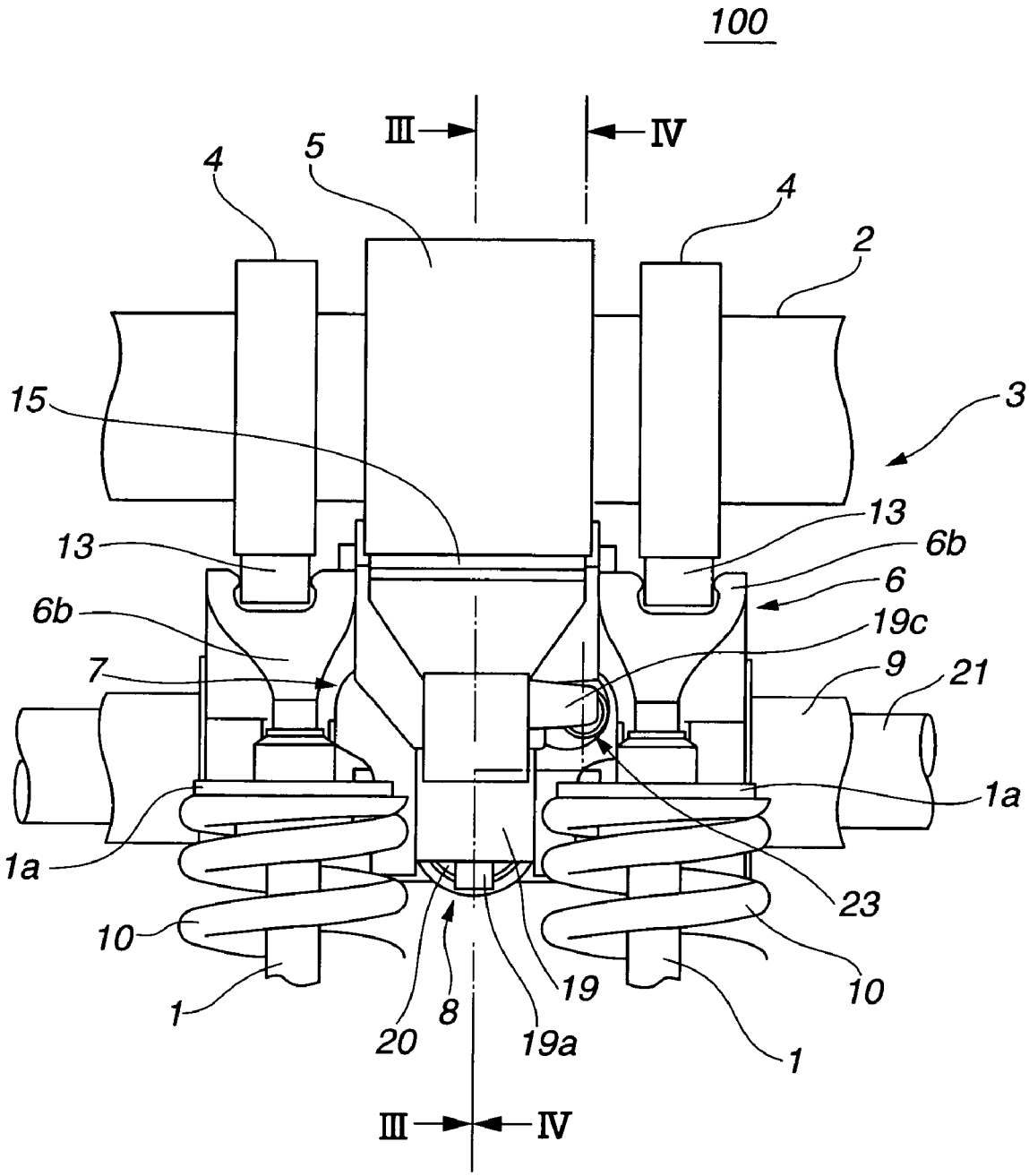
FIG. 2 is a side view of an essential portion of the valve actuation device of the first embodiment, showing a lift varying mechanism.

As is understood from FIG. 2, the internal combustion engine shown is of a type that has two intake valves 1 and 1 for each cylinder. Although not shown in the drawing, each intake valve 1 is slidably received in a cylinder head of the engine.

As is understood from the drawings, particularly FIG. 2, valve actuation device 100 comprises a camshaft 2 that is rotatably supported on the cylinder head through cam brackets (not shown) and driven by a crankshaft (not shown) of the engine through a chain, and a lift varying mechanism 3 that is provided for each cylinder to vary the lift degree of intake valves 1 and 1 in accordance with an operation condition of the engine.

Each intake valve 1 has at a stem end thereof a spring retainer 1*a* against which one end of a valve spring 10 is pressed, so that intake valve 1 is biased in a direction to close an intake port (not shown) formed in the cylinder head.

Figure 3:
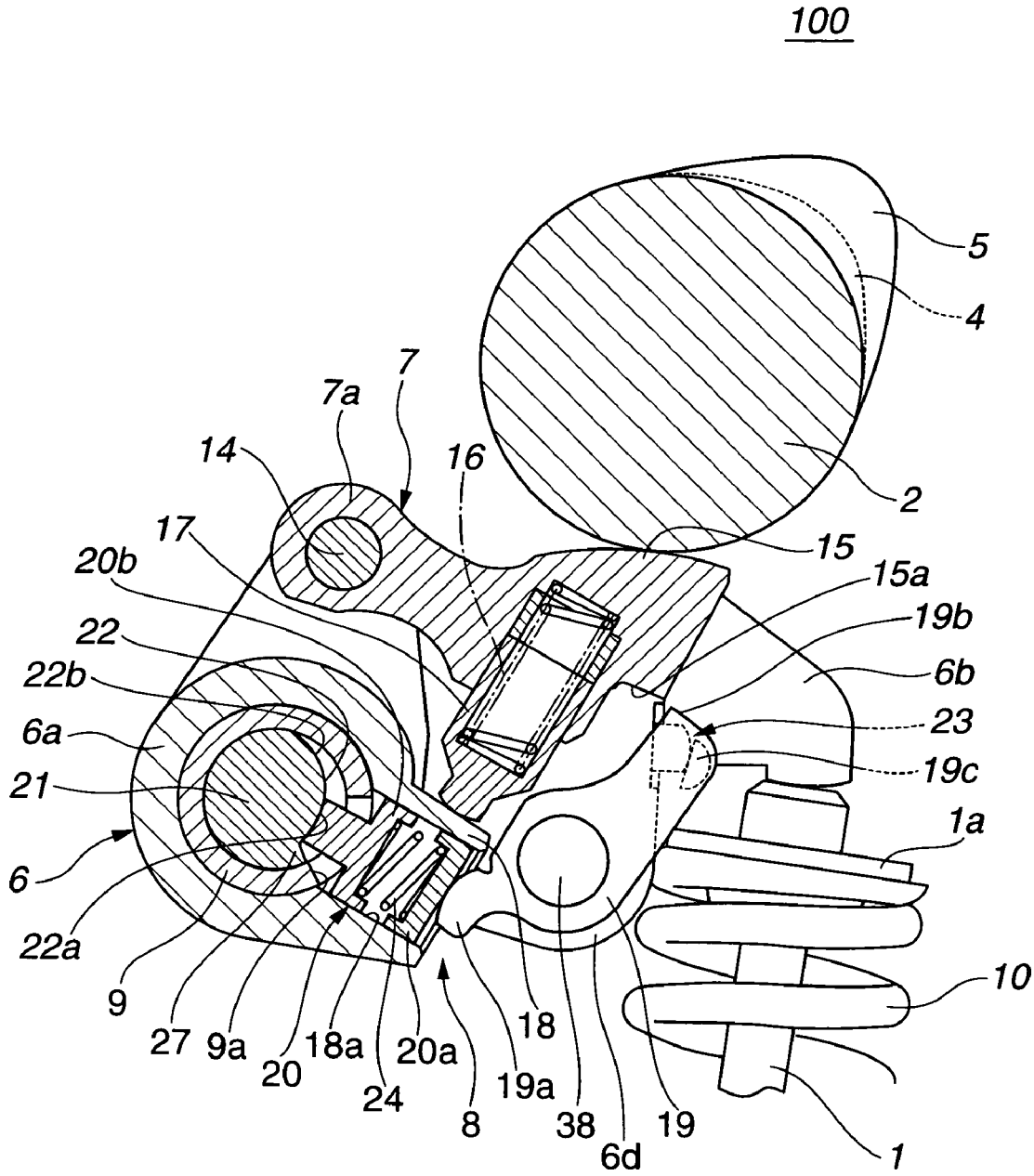
FIG. 3 is a sectional view taken along the line III-III of FIG. 2.

As is understood from FIGS. 2 to 5, particularly FIGS. 2 and 3, lift varying mechanism 3 generally comprises two first cams 4 and 4 that are provided on camshaft 2 for respective intake valves 1 and 1, a second cam 5 that is provided on camshaft 2 between first cams 4 and 4, a forked main rocker arm 6 that has arm portions contacting peripheral surface of respective first cams 4 and 4, a sub-rocker arm 7 that is pivotally supported by main rocker arm 6, and a coupling mechanism 8 that couples and uncouples main rocker arm 6 and sub-rocker arm 7 selectively.

The two first cams 4 and 4 have different cam profiles that satisfy a valve lift characteristic of the two intake valves 1 and 1 needed when the engine is under a very low speed operation (viz., idling) and a normal speed operation. The two first cams 4 and 4 may have different sizes so long as they have a similar figure.

Second cam 5 has a cam profile that satisfies a valve lift characteristic of the two intake valves 1 and 1 needed when the engine is under a lower and intermediate speed operation in the normal cruising of the vehicle. More specifically, the cam profile of second cam 5 is shaped to cause a larger lift degree and greater working angle of intake valves 1 and 1 than those caused by first cams 4 and 4.

As is seen from FIG. 1, main rocker arm 6 is generally U-shaped when viewed from the above and comprises a base portion 6*a* that is swingably supported by the cylinder head through a hollow main rocker shaft 9 that is commonly used for main rocker arms for the other cylinders (not shown), and two arm portions 6*b* and 6*b* that extend rightward in the drawing from axially opposed ends of base portion 6*a*. As is seen from FIG. 3, each arm portion 6*b* has a leading end that is in contact with a stem head of the corresponding intake valve 1.

Referring back to FIG. 1, between two arm portions 6*b* and 6*b*, there is defined a rectangular recess 12, and each arm portion 6*b* has near the leading end thereof a rectangular opening 11. A roller 13 is rotatably set in each rectangular opening 11 through a shaft needle bearing (not shown).

As is seen from FIG. 2, the two rollers 13 and 13 provided by main rocker arm 6 are operatively put on first cams 4 and 4 respectively.

Referring back to FIG. 1, the above-mentioned sub-rocker arm 7 is set in rectangular recess 12 of main rocker arm 6.

As is well seen from FIG. 3, sub-rocker arm 7 comprises a base portion 7*a* that is pivotally supported by base portion 6*a* of main rocker arm 6 through a sub-rocker shaft 14.

It is to be noted that sub-rocker arm 7 has no portion or portions that directly contact the stem heads of intake valves 1 and 1. That is, as is seen from FIGS. 1 and 3, a leading portion of sub-rocker arm 7 is formed with a rounded cam follower portion 15 that is in contact with the above-mentioned second cam 5.

As is seen from FIG. 3, in sub-rocker arm 7 at a position below cam follower portion 15, there is defined a cylindrical bore that has a lost motion coil spring 16 installed therein for pressing cam follower portion 15 against second cam 5. Coil spring 16 has a lower half portion received in a cylindrical spring retainer 17 that is slidably received in the cylindrical bore of sub-rocker arm 7. Spring retainer 17 has a projected lower end that is pressed against an upper side wall of a cylindrical projection 18 formed on a projected part of base portion 6*a* of main rocker arm 6.

As is understood from FIGS. 1 and 3, sub-rocker shaft 14 is circumferentially slidably received in a cylindrical bore formed in base portion 7*a* of sub-rocker arm 7, and has both ends tightly grasped by supporting pieces 6*d* and 6*d* that are integrally formed on base portion 6*a* of main rocker arm 6 near rectangular recess 12.

As is seen from FIGS. 2 and 3, coupling mechanism 8 comprises a lever member 19 that connects main rocker arm 6 and sub-rocker arm 7, a plunger 20 that is slidably received in a cylindrical bore 18*a* formed in the above-mentioned cylindrical projection 18 of main rocker arm 6 and has one end that is in contact with a lower projection 19*a* of lever member 19, a control shaft 21 that is rotatably received in the above-mentioned hollow main rocker shaft 9 and a control cam 22 that is integrally formed on control shaft 21 and contacts the other end of the plunger 20 through an opening 9*a* formed in hollow main rocker shaft 9.

As is seen from FIG. 3, lever member 19 is rotatably supported at its middle portion by a supporting shaft 38 that extends between the above-mentioned supporting pieces 6*d* and 6*d* formed on base portion 6*a* of main rocker arm 6, so that lever member 19 can swing toward and away from sub-rocker arm 7. Lever member 19 has an upper end surface 19*b* that is selectively engageable with an engaging surface 15*a* provided at a lower surface of the above-mentioned cam follower portion 15 of sub-rocker arm 7. That is, in accordance with an angular position of lever member 19, the upper end surface 19*b* is selectively engaged with or disengaged from the engaging surface 15*a* of the cam follower portion 15.

Figure 4:
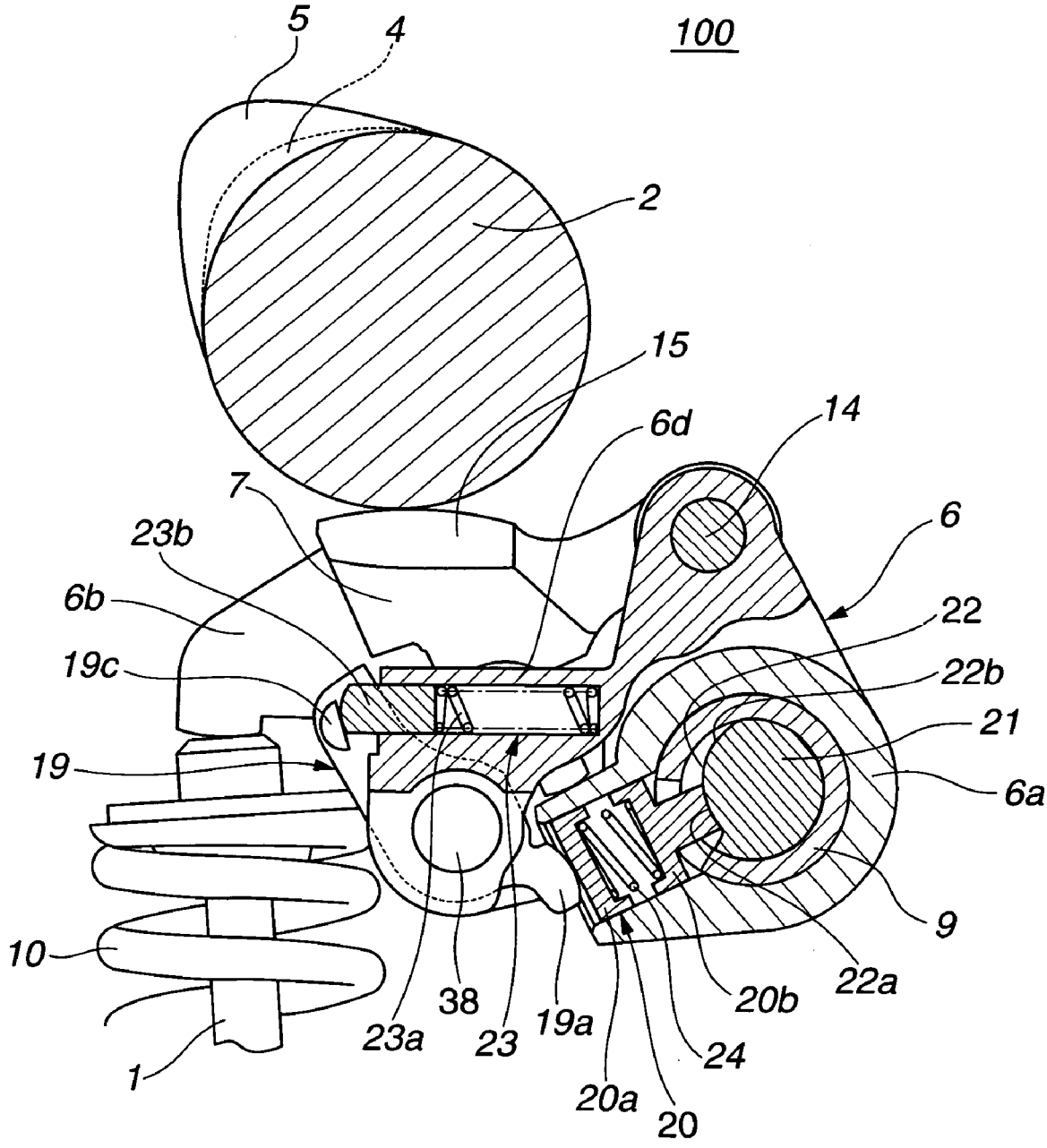
FIG. 4 is a sectional view taken along the line IV-IV of FIG. 2.
Figure 5:
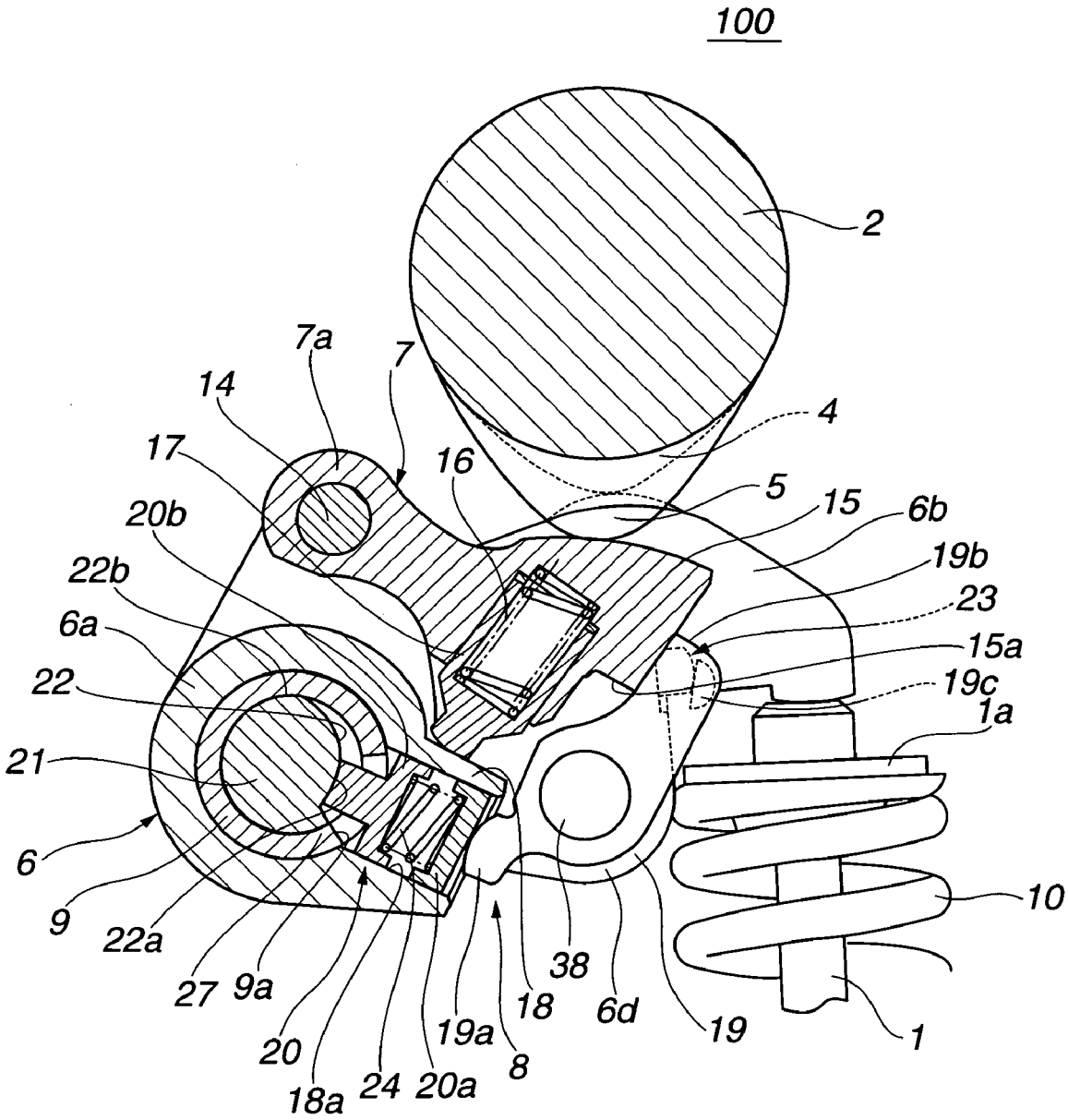
FIG. 5 is a view similar to FIG. 3, but showing an OFF or uncoupled condition of a coupling mechanism employed in the first embodiment.

As is seen from FIGS. 2, 3 and 4, due to work of a biasing mechanism 23 that is provided on one of the supporting pieces 6*d* and 6*d* of main rocker arm 6, lever member 19 is biased in a direction to cancel the engagement with the above-mentioned cam follower portion 15. Biasing mechanism 23 comprises a coil spring 23*a* that is installed in a cylindrical bore formed in the supporting piece 6*d*, a pressing piston 23*b* that is slidably received in the cylindrical bore in a manner to be pressed by coil spring 23*a* , and a projection 19*c* that is formed on one upper side surface of lever member 19 and pressed by pressing piston 23*b*. That is, in FIG. 4, due to provision of biasing mechanism 23, lever member 19 is biased to pivot in a counterclockwise direction about supporting shaft 38.

As is best seen from FIGS. 3 and 4, the above-mentioned plunger 20 is of a split structure, which includes an outer element 20*a* that is in contact with the above-mentioned lower projection 19*a* of lever member 19 and an inner element 20*b* that has a cylindrical projection (no numeral) contacting with the above-mentioned control cam 22.

Between outer and inner elements 20*a* and 20*b*, there is compressed a coil spring 24.

It is to be noted that the biasing force produced by coil spring 24 is set greater than that produced by the above-mentioned coil spring 23*a* of biasing mechanism 23, so that the ON/OFF connection between main rocker arm 6 and sub-rocker arm 7 is smoothly carried out without having undesired effect on the response characteristic.

As is seen from FIG. 1, the above-mentioned control shaft 21 has one end 21*a* driven by a DC electric motor 26 through a speed reduction mechanism 25. That is, by the motor 26, control shaft 21 is rotated in one and other directions.

Figure 6:
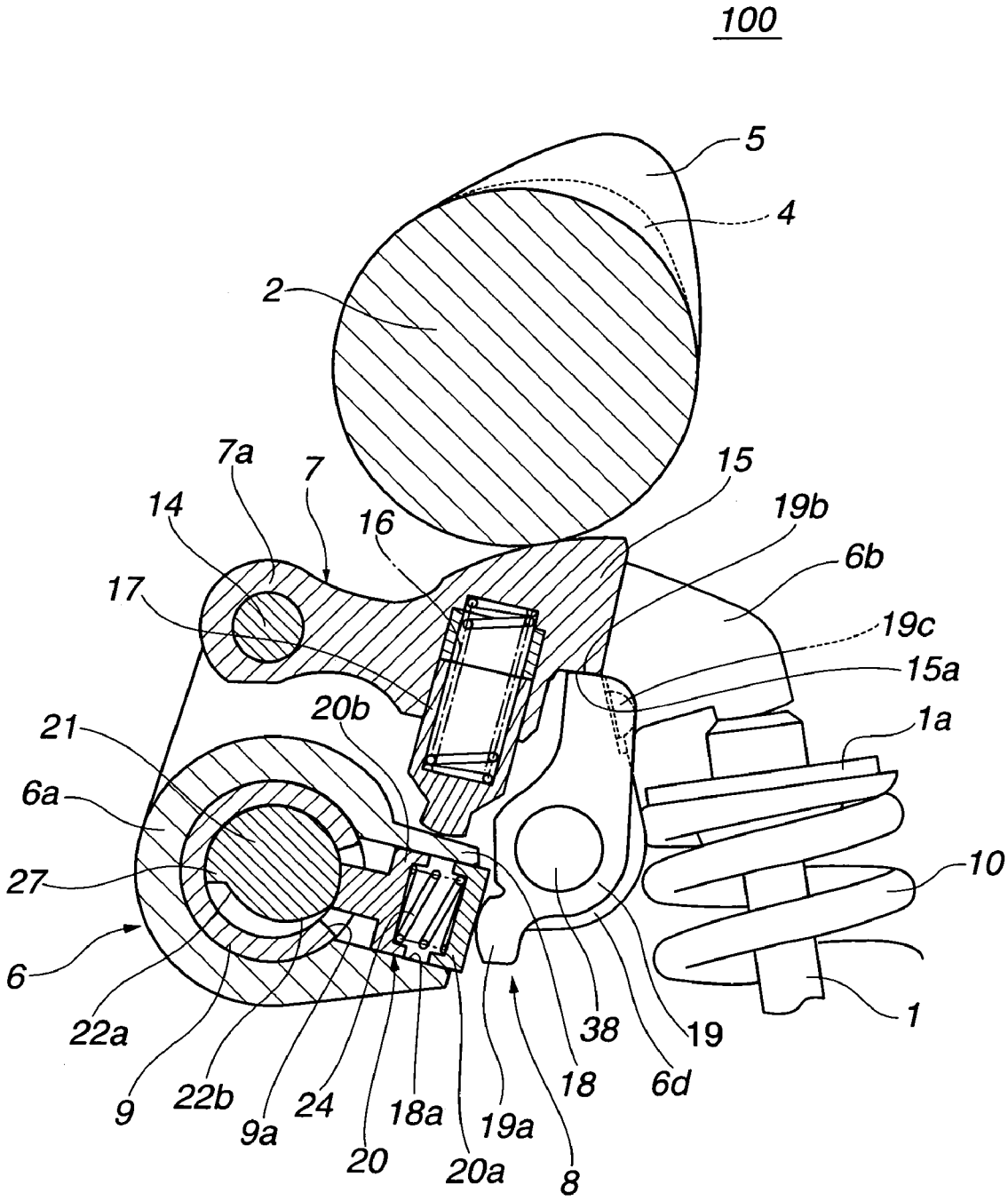
FIG. 6 is a view similar to FIG. 3, but showing an ON or coupled condition of the coupling mechanism.
Figure 7:
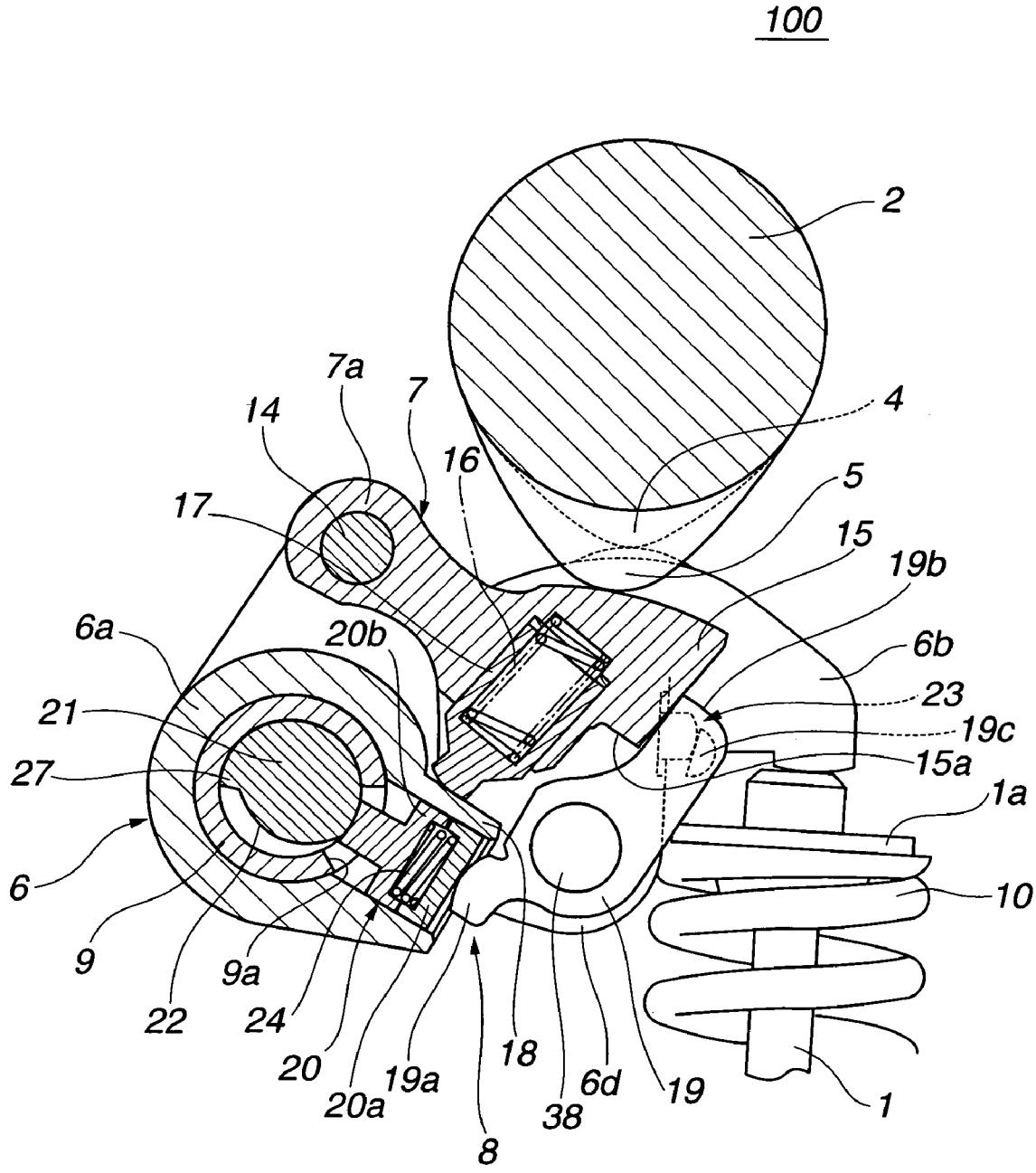
FIG. 7 is a view also similar to FIG. 3, but showing a transient condition of the coupling mechanism that is taken when the coupling mechanism is shifted from the Off or uncoupled condition of FIG. 5 to the ON or coupled condition of FIG. 6.
Figure 8:
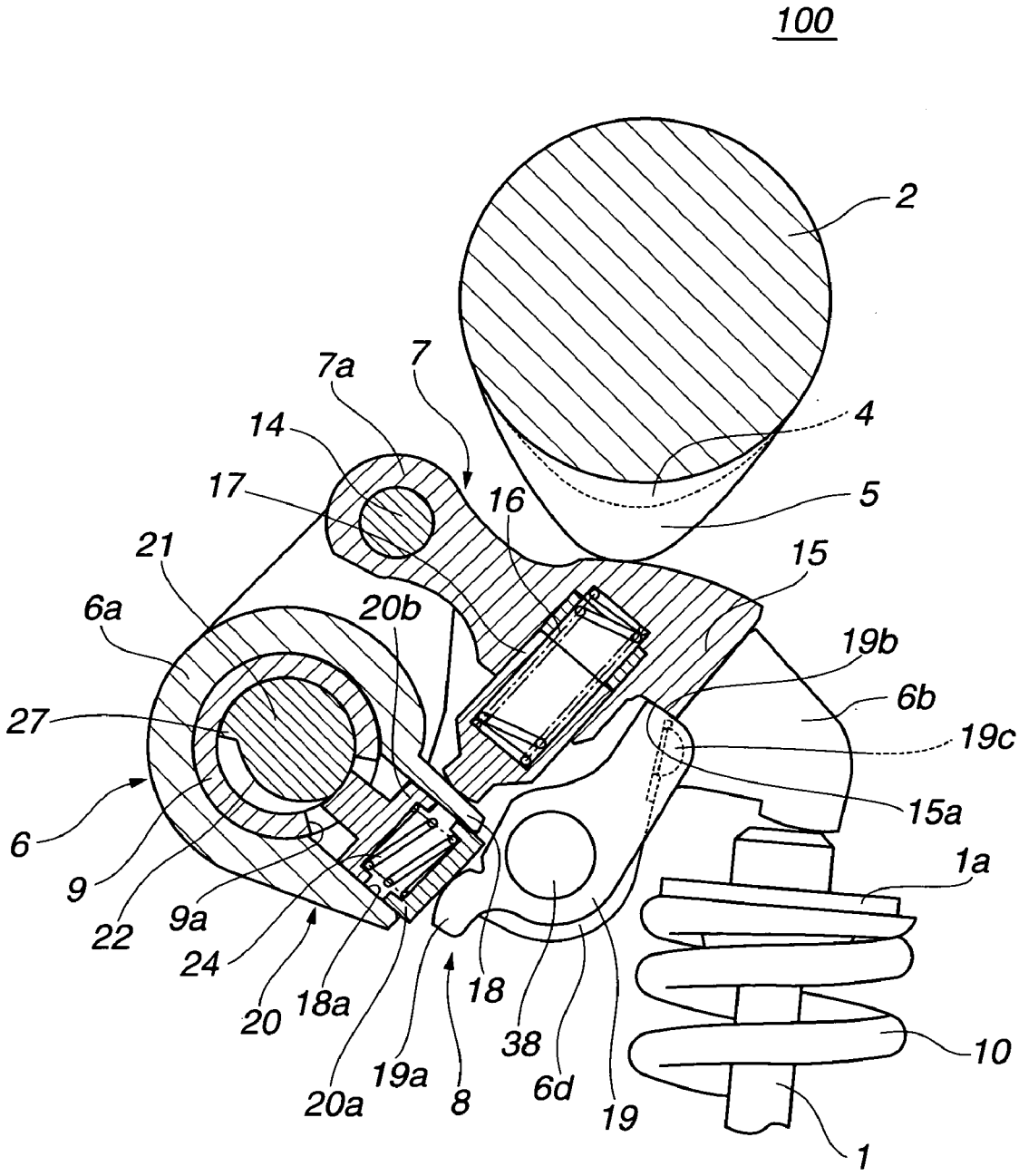
FIG. 8 is a view similar to FIG. 6, showing the ON or coupled condition of the coupling mechanism with a higher speed cam kept activated.

As is seen from FIG. 3, the above-mentioned control cam 22 comprises a crescent recess formed on control shaft 21. Actually, the crescent recess has a depth that gradually reduces as the position changes in a counterclockwise direction in the drawing from a deepest part 22*a* toward a shallowest part 22*b*. That is, when control cam 22 takes a deepest position where as shown in the drawing the cylindrical projection of inner element 20*b* engages the deepest part 22*a*, lever member 19 takes its clockwise-most position disengaging upper end surface 19*b* thereof from engaging surface 16*a* of sub-rocker arm 7. Under this condition, the coupling between main rocker arm 6 and sub-rocker arm 7 is canceled. While, when control cam 22 is rotated in a clockwise direction from the deepest position, the cam surface defined by a bottom of the crescent recess moves plunger 20 rightward in FIG. 3 thereby pivoting lever member 19 in a counterclockwise direction and finally engaging upper end surface 19*b* of lever member 19 with engaging surface 16*a* of sub-rocker arm 7. Upon this, as is shown in FIG. 6, main rocker arm 6 and sub-rocker arm 7 become coupled.

As is seen from FIG. 3, control cam 22 is formed near the deepest part 22*a* with a stopper portion 27. Due to provision of this stopper portion 27 against which the cylindrical projection of inner element 20*b* of plunger 20 is contactable, the counterclockwise rotation of control cam 22 is assuredly stopped when control cam 22 comes to the deepest position as shown in the drawing.

Referring back to FIG. 1, electric motor 26 is controlled by a control unit 28. As shown, control unit 28 receives information on engine speed from a crank angle sensor (CAS) 29, information on engine load from an air flow meter (AFM) 30, information on throttle valve open degree from a throttle sensor (TS) 31 and other information from various sensor means. That is, by processing these information, control unit 28 detects an operation condition of the engine and controls electric motor 26 in accordance with the detected operation condition of the engine.

In the following, operation of the first embodiment 100 will be described with the aid of the drawings.

When, just after starting of the engine, the engine is in an idling condition, control unit 28 (see FIG. 1) causes electric motor 26 to rotate in one direction for a given time.

With this, control shaft 21 is turned in one direction by a certain angle. Thus, as is seen from FIG. 3, control cam 22 formed on control shaft 21 is turned to a given angular position where the cylindrical projection of inner element 20*b* of plunger 20 engages with the deepest part 22*a* of control cam 22. During this turning of control cam 22, the entire construction of plunger 20 is moved leftward in FIG. 3. Thus, due to the biasing force of the biasing mechanism 23 (see FIG. 4), lever member 19 is turned clockwise in FIG. 3 disengaging upper end surface 19*b* thereof from engaging surface 16*a* of sub-rocker arm 7 thereby canceling the coupling between main rocker arm 6 and sub-rocker arm 7.

Thus, under this condition, main rocker arm 6 is forced to swing having the two rollers 13 and 13 operatively put on respective first cams 4 and 4. For the reasons as mentioned hereinabove, under this condition, the lift degree and working angle of intake valves 1 and 1 are small, which is suitable for the idling condition of the engine.

Under this condition, sub-rocker arm 7 is forced to swing by second cam 5. However, due to uncoupling from main rocker arm 6, the swinging of sub-rocker arm 7 has no effect on the lift characteristic of intake valves 1 and 1.

While, when, due to a normal cruising of the vehicle, the engine runs at a normal speed, control unit 28 causes electric motor 26 to rotate in the other direction for a certain time.

With this, control shaft 21 is turned in the other direction by a certain angle. Thus, as is seen from FIG. 6, control cam 22 formed on control shaft 21 comes to an angular position where the cylindrical projection of inner element 20*b* of plunger 20 engages with the shallowest part 22*b* of control cam 22, as shown. During this turning of control cam 22, the entire construction of plunger 20 is moved rightward in FIG. 6 thereby turning lever member 19 counterclockwise against the force of the biasing mechanism 23. Thus, upper end surface 19*b* of lever member 19 is brought into engagement with engaging surface 16*a* of sub-rocker arm 7 thereby tightly coupling main rocker arm 6 and sub-rocker arm 7. This means that main rocker arm 6 and sub-rocker arm 7 constitute a single structure.

It is to be noted that as will be understood from FIG. 6, the timing of the coupling between the two rocker arms 6 and 7 coincides with the time when cam follower portion 15 of sub-rocker arm 7 contacts a base circle part of the cam profile of second cam 5 (see FIG. 2).

Thus, under this condition, main rocker arm 6 (more specifically, the coupled structure including the two rocker arms 6 and 7) is forced to swing having cam follower portion 15 of sub-rocker arm 7 operatively put on second cam 5. For the reasons as mentioned hereinabove, under this condition, the lift degree and working angle of intake valves 1 and 1 are large, which is suitable for the normal speed condition of the engine.

In this condition, the two rollers 13 and 13 of main rocker arm 6 become separated from first cams 4 and 4 when cam follower portion 15 of sub-rocker arm 7 is pushed down by the lobe portion of second cam 5, and thus, the frequent contact of two rollers 13 and 13 to first cams 4 and 4 have no effect on the lift characteristic of intake valves 1 and 1.

When now the engine is returned to the idling condition from the normal speed condition, control unit 28 causes electric motor 26 to rotate in the one direction for a certain time.

With this, control shaft 21 and thus control cam 22 are turned back to the above-mentioned original positions as shown in FIG. 3 where the cylindrical projection of inner element 20*b* of plunger 20 engages with the deepest part 22*a* of control cam 22. During this, plunger 20 is moved leftward in FIG. 3 to turn lever member 19 clockwise in FIG. 3 with the aid of the biasing force of biasing mechanism 23 thereby canceling the coupling between main rocker arm 6 and sub-rocker arm 7.

Under this condition, for the reasons as mentioned hereinabove, the lift degree and working angle of intake valves 1 and 1 are small.

As is described hereinabove, in the first embodiment 100, the ON/OFF switching of coupling mechanism 8 is directly carried out by electric motor 26 controlled by control unit 28. As is easily known, in case of direct using of such electric power, the ON/OFF switching of coupling mechanism 8 is assuredly and speedily carried out. It is now to be noted that in the above-mentioned known technique disclosed by Japanese Laid-open Patent Application (Tokkaihei) 5-171909, such ON/OFF switching of the coupling mechanism is carried out with a hydraulic power, which tends to bring about a dull switching operation of the coupling mechanism particularly in an engine idling condition just after starting of the engine because of insufficient hydraulic power.

Because of provision of stopper portion 27 on control cam 22, the cylindrical projection of plunger 20 can be assuredly set to the deepest part 22*a* of the control cam 22. Accordingly, the timing of the coupling/uncoupling between main rocker arm 6 and sub-rocker arm 7 is assuredly held.

Because of provision of coil spring 24 between outer and inner elements 20*a* and 20*b* of plunger 20, any shock that would be applied to plunger 20 by the force of valve spring 10 when coupling mechanism 8 fails to carry out a proper switching operation can be optimally damped. That is, if intake valves 1 and 1 are forced to make an open operate under a condition wherein main rocker 6 and sub-rocker arm 7 are incompletely coupled by coupling mechanism 8, plunger 20 is suddenly forced backward (that is, leftward in FIG. 3) by the force of valve spring 10 through cam follower portion 15 and lever member 19. However, dud to the work of the spring 24, such sudden force application is damped. This means reduction in shock applied to coupling mechanism 8, control cam 22 and electric motor 26 and thus durability of such parts 8, 22 and 26 is increased.

As is mentioned hereinabove, the biasing force produced by coil spring 24 is set greater than that produced by coil spring 23*a* of biasing mechanism 23. Thus, upon switching from uncoupling to coupling of coupling mechanism 8, it never occurs that lever member 19 is forced to rotate in a clockwise direction in FIG. 3 by the force of coil spring 23*a*. That is, upon such switching, it never occurs that outer and inner elements 20*a* and 20*b* of plunger 20 are moved toward each other compressing coil spring 24. This means improved responsibility in operation of coupling mechanism 8. In other words, under normal operation of coupling mechanism 8, it never occurs that coil spring 24 is compressed, and thus, it never occurs that the force of coil spring 24 affects the responsibility in operation of coupling mechanism 8.

In the embodiment 100, respective coupling mechanisms 8 for all cylinders of the engine are controlled at the same time by a common actuator that includes speed reduction mechanism 25, electric motor 26 and control unit 28. This actuation mechanism brings about reduction in cost of the valve actuation device 100.

Figure 9:
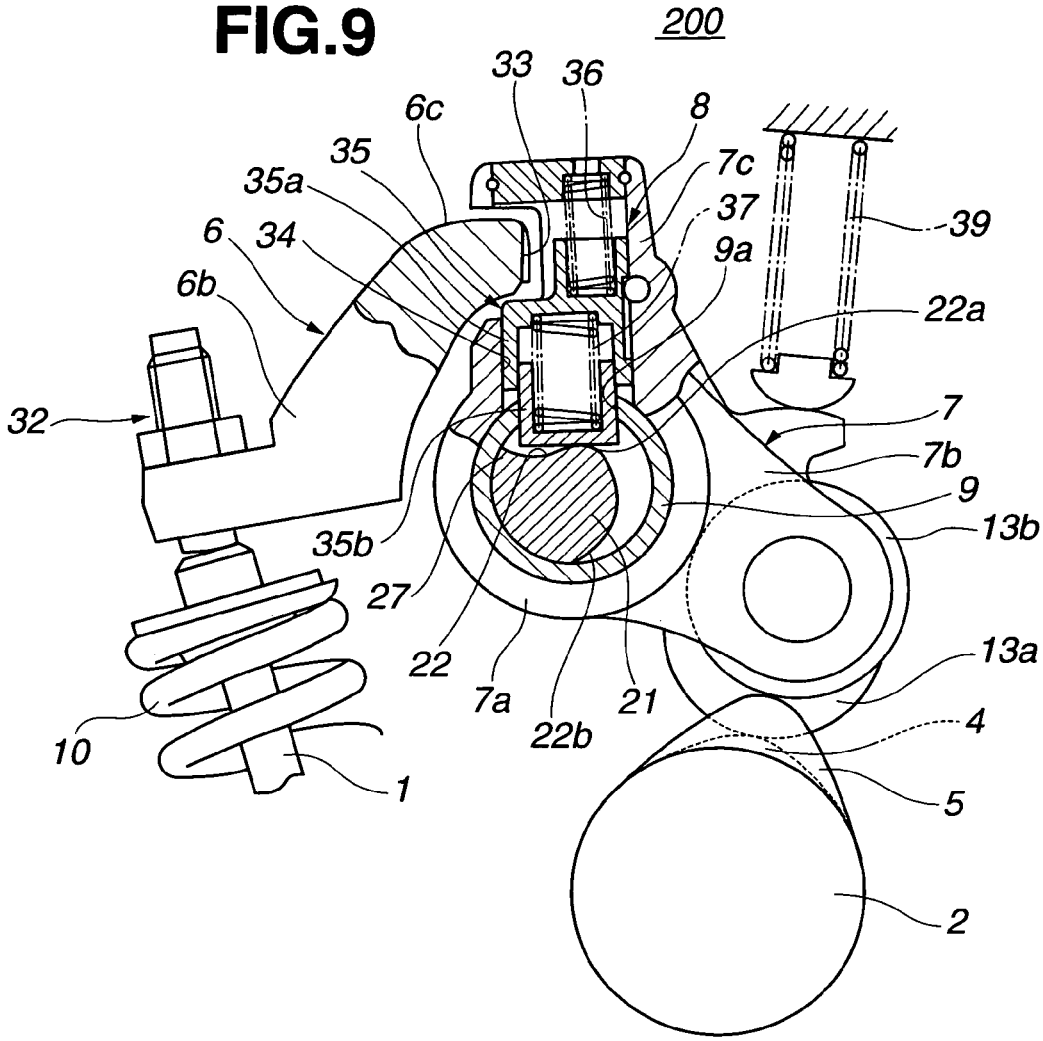
FIG. 9 is a sectional view of a valve actuation device of a second embodiment of the present invention, showing an Off or uncoupled condition of a coupling mechanism employed in the second embodiment.
Figure 10:
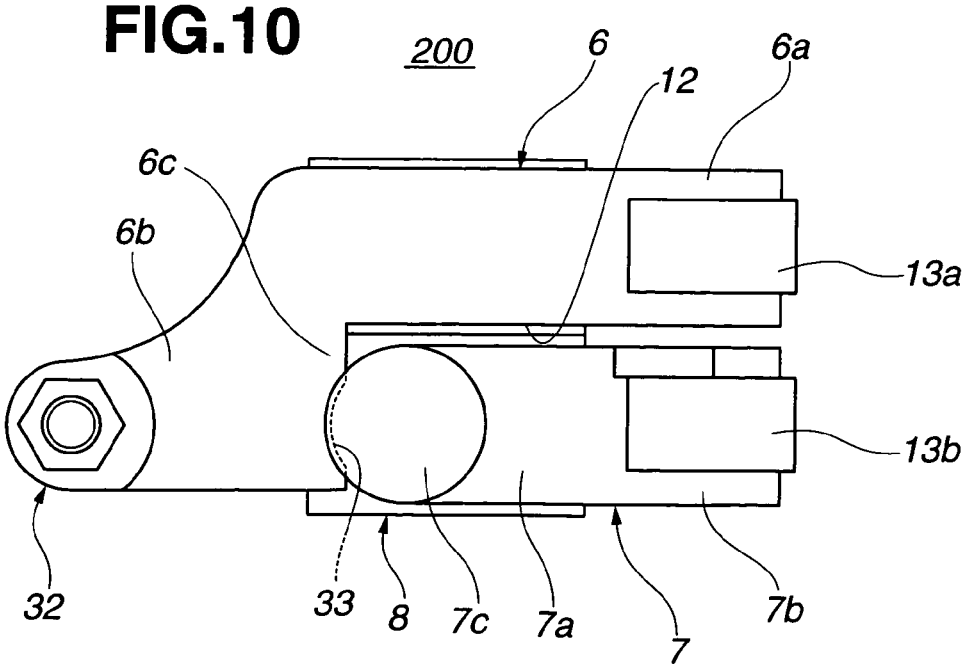
FIG. 10 is a plan view of a lift varying mechanism employed in the valve actuation device of the second embodiment.
Figure 11:
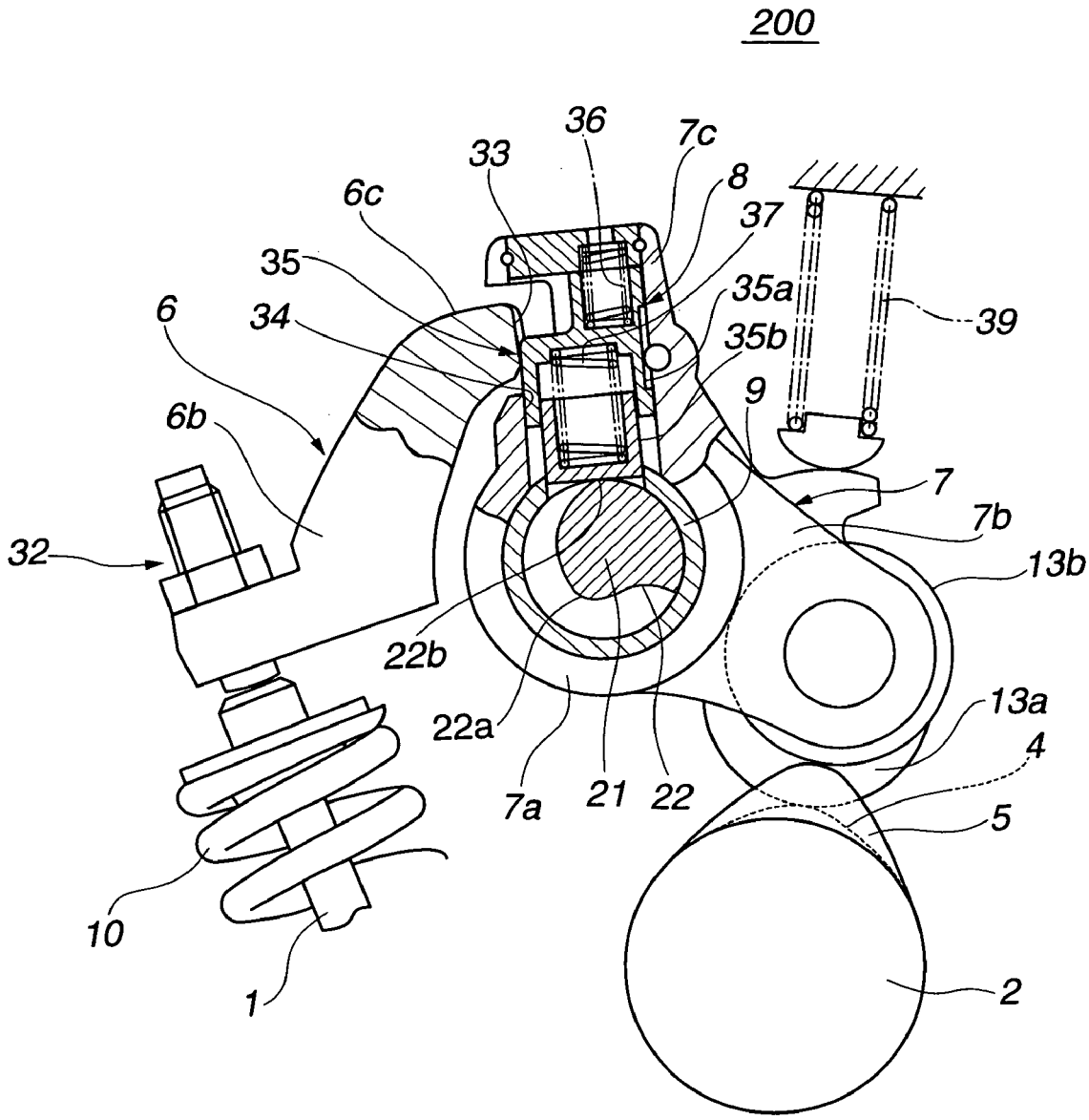
FIG. 11 is a view similar to FIG. 9, but showing an ON or coupled condition of the coupling mechanism employed in the second embodiment.

Referring to FIGS. 9 to 11, there is shown a valve actuation device 200 of an internal combustion engine, which is a second embodiment of the present invention.

In this embodiment 200, valve actuation device 200 is applied to an internal combustion engine of a type that has one intake valve 1 for each cylinder.

As is understood from FIG. 9, valve actuation device 200 comprises a camshaft 2 that has, for each cylinder, a first cam 4 and a second cam 5 integrally formed thereon. First cam 4 is shaped to satisfy a valve lift characteristic of intake valve 1 needed when the engine is under a very low speed operation (viz., idling), and second cam 5 is shaped to satisfy the valve lift characteristic of intake valve 1 needed when the engine is under a normal speed operation.

Above first and second cams 4 and 5, there is positioned a main rocker arm 6 that is pivotally supported by a hollow rocker shaft 9.

As is seen from FIG. 10, main rocker arm 6 has at one end 6*a* thereof a roller 13*a* that is operatively put on first cam 4, and at the other end 6*b* thereof a lash adjuster 32 of which bottom end is in contact with a stem head of intake valve 1. Main rocker arm 6 has at one side a rectangular recess 12 in which a sub-rocker arm 7 rotatably supported by hollow rocker shaft 9 is received.

As is understood from FIG. 9, sub-rocker arm 7 comprises a base portion 7*a* that is pivotally supported by hollow rocker shaft 9 and a leading portion 7*b* that has a roller 13*b* operatively put on second cam 5.

Base portion 7*a* of sub-rocker arm 7 is integrally formed at an upper part thereof with a raised wall 7*c*.

Between raised wall 7*c* and a bent middle portion 6*c* of main rocker arm 6, there is arranged a coupling mechanism 8.

As is seen from FIG. 9, coupling mechanism 8 comprises an arcuate engaging surface 33 that is provided at bent middle portion 6*c* of main rocker arm 6 and a plunger 35 that is slidably received in a vertically extending bore 34 formed in raised wall 7*c* of sub-rocker arm 7. Plunger 35 has a side surface that is engageable with arcuate engaging surface 33.

Coupling mechanism 8 further comprises a coil spring 36 that is installed in raised wall 7*c* to bias plunger 35 downward, that is, in a direction to move plunger 35 away from arcuate engaging surface 33, a control shaft 21 that is rotatably received in hollow rocker shaft 9 and a control cam 22 that is integrally formed on control shaft 21.

Plunger 35 is of a split and cylindrical structure, which includes a larger cylindrical upper element 35*a* that slides in bore 34 of raised wall 7*c* to selectively engage with and disengage from arcuate engaging surface 33 of main rocker arm 6, a smaller cylindrical lower element 35*b* that slides in the upper element 35*a* and, a coil spring 37 that is compressed between upper and lower elements 35*a* and 35*b*. Lower element 35*b* has a lower surface that operatively contacts control cam 22 through an opening 9*a* provided in the cylindrical wall of hollow rocker shaft 9.

It is to be noted that the biasing force produced by coil spring 37 is set greater than that produced by the above-mentioned coil spring 36, so that the ON/OFF connection between main rocker arm 6 and sub-rocker arm 7 is smoothly carried out without having undesired effect on the response characteristic.

Since the construction and arrangement of control shaft 21, control cam 22 and stopper portion 27 are substantially the same as those of the above-mentioned first embodiment 100, repeated description of them will be omitted.

In the following, operation of the second embodiment 200 will be described with the aid of FIGS. 9 and 1.

When the engine is in an idling condition, control unit 28 (see FIG. 1) causes electric motor 26 to rotate in one direction for a given time.

With this, control shaft 21 is turned in one direction by a certain angle. Thus, as is seen from FIG. 9, control cam 22 formed on control shaft 21 is turned to a certain angular position where a lower edge of lower element 35*b* of plunger 35 engages with the deepest part 22*a* of control cam 22. During this turning of control cam 22, the entire construction of plunger 35 is moved toward an axis of control shaft 21, that is, downward in FIG. 9, due to the biasing force of coil spring 36, so that an outside surface of upper element 35*a* becomes disengaged from engaging surface 33 of main rocker arm 6 thereby canceling the tight coupling between main rocker arm 6 and sub-rocker arm 7.

Thus, under this condition, main rocker arm 6 is forced to swing having the roller 13*a* operatively put on first cam 4. For the reasons as mentioned hereinabove, under this condition, the lift degree and working angle of intake valve 1 is small, which is suitable for the idling condition of the engine.

Under this condition, sub-rocker arm 7 is forced to swing by second cam 5. However, due to uncoupling from main rocker arm 6, the swinging of sub-rocker arm 7 has no effect on the lift characteristic of intake valve 1.

While, when, due to a normal cruising of the vehicle, the engine runs at a normal speed, control unit 28 causes electric motor 26 to rotate in the other direction for a certain time.

With this, control shaft 21 is turned in the other direction by a certain angle. Thus, as is seen from FIG. 11, control cam 22 formed on control shaft 21 comes to an angular position where lower element 35*b* of plunger 35 engages with the shallowest part 22*b* of control cam 22, as shown. During this turning of control cam 22, the entire construction of plunger 35 is moved upward in the drawing, so that the outside surface of upper element 35*a* is brought into engagement with engaging surface 33 of main rocker arm 6 thereby tightly coupling main rocker arm 6 and sub-rocker arm 7. This means that main rocker arm 6 and sub-rocker arm 7 constitute a single structure.

It is to be noted that as will be understood from FIG. 6, the timing of the coupling between the two rocker arms 6 and 7 coincides with the time when sub-rocker arm 7 contacts a base circle part of the cam profile of second cam 5.

Thus, under this condition, main rocker arm 6 (more specifically, the coupled structure including the two rocker arms 6 and 7) is forced to swing having sub-rocker arm 7 operatively put on second cam 5. For the reasons as mentioned hereinabove, under this condition, the lift degree and working angle of intake valve 1 are large, which is suitable for the normal speed condition of the engine.

When now the engine is returned to the idling condition from the normal speed condition, control unit 28 causes electric motor 26 to rotate in the one direction for a certain time.

With this, control shaft 21 and thus control cam 22 are turned back to the above-mentioned original positions as shown in FIG. 9. During this, plunger 35 is moved downward in the drawing with the aid of the biasing force of coil spring 36. Thus, the outside surface of upper element 35*a* is disengaged from engaging surface 33 of main rocker arm 6 thereby canceling the tight coupling between main rocker arm 6 and sub-rocker arm 7. Under this condition, the lift degree and working angle of intake valve are small.

As is described hereinabove, also in this second embodiment 200, the ON/OFF switching of coupling mechanism 8 is directly carried out by electric motor 26 controlled by control unit 28. Accordingly, the various advantages of the above-mentioned first embodiment 100 are equally enjoyed by the second embodiment 200. Provision of stopper portion 27 on control cam 22 and usage of coil spring 37 as a damping means bring about the same advantageous operation as those of the above-mentioned first embodiment 100.

Referring to FIGS. 12 to 16, there is shown a valve actuation device 300 of an internal combustion engine, which is a third embodiment of the present invention.

In this third embodiment 300, valve actuation device 300 is applied to an internal combustion engine of a type that has two intake valves 1 and 1 for each cylinder, like in the first embodiment 100.

However, as will become apparent as the description proceeds, in the third embodiment 300, there are different constructions in lift varying mechanism 3 and coupling mechanism 8 as compared with the first embodiment 100.

That is, like the first embodiment 100, in the third embodiment 300, cam shaft 2 is formed with two first cams 4 and 4 for a lower speed operation of the engine and a second cam 5 between first cams 4 and 4 for a higher speed operation of the engine.

Figure 13:
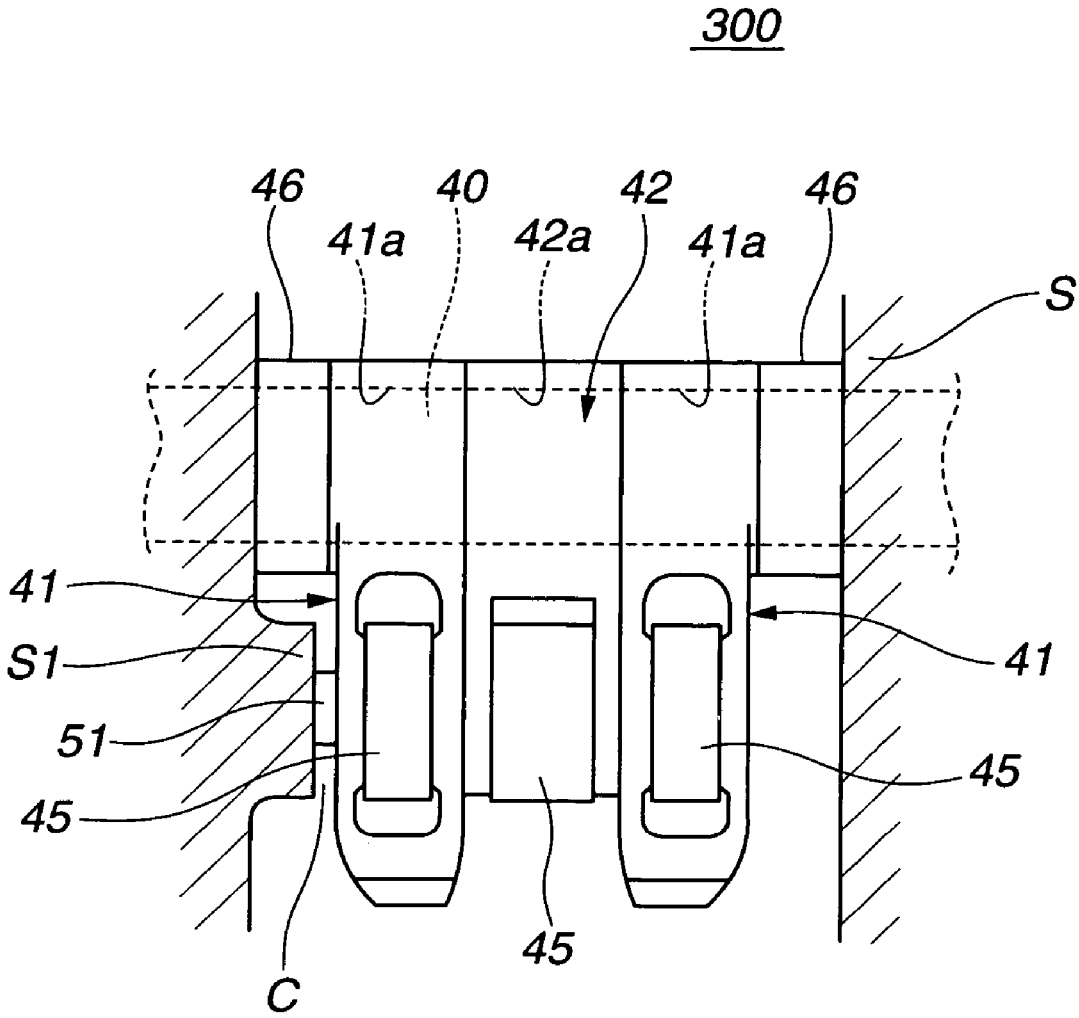
FIG. 13 is a plan view of the essential portion of the third embodiment.

However, as is seen from FIG. 13, in the third embodiment 300, two outside first rocker arms 41 and 41 are arranged which respectively contact first cams 4 and 4, and a single second rocker arm 42 is swingably arranged between the two first rocker arms 41 and 41.

Although not well shown in the drawings, like in the above-mentioned first embodiment 100, each intake valve 1 is biased in a direction to close a corresponding intake port by a valve spring held by a spring retainer.

Referring back to FIG. 13, two first rocker arms 41 and 41 and single second rocker arm 42 are pivotally supported by a rocker shaft 40 through respective circular openings 41*a*, 41*a* and 42*a* thereof. Rocker shaft 40 has axial ends that are fixed to cylinder head S.

Although not shown in the drawings, two first rocker arms 41 and 41 have leading end portions that are in contact with stem heads of intake valves 1 and 1.

Figure 14:
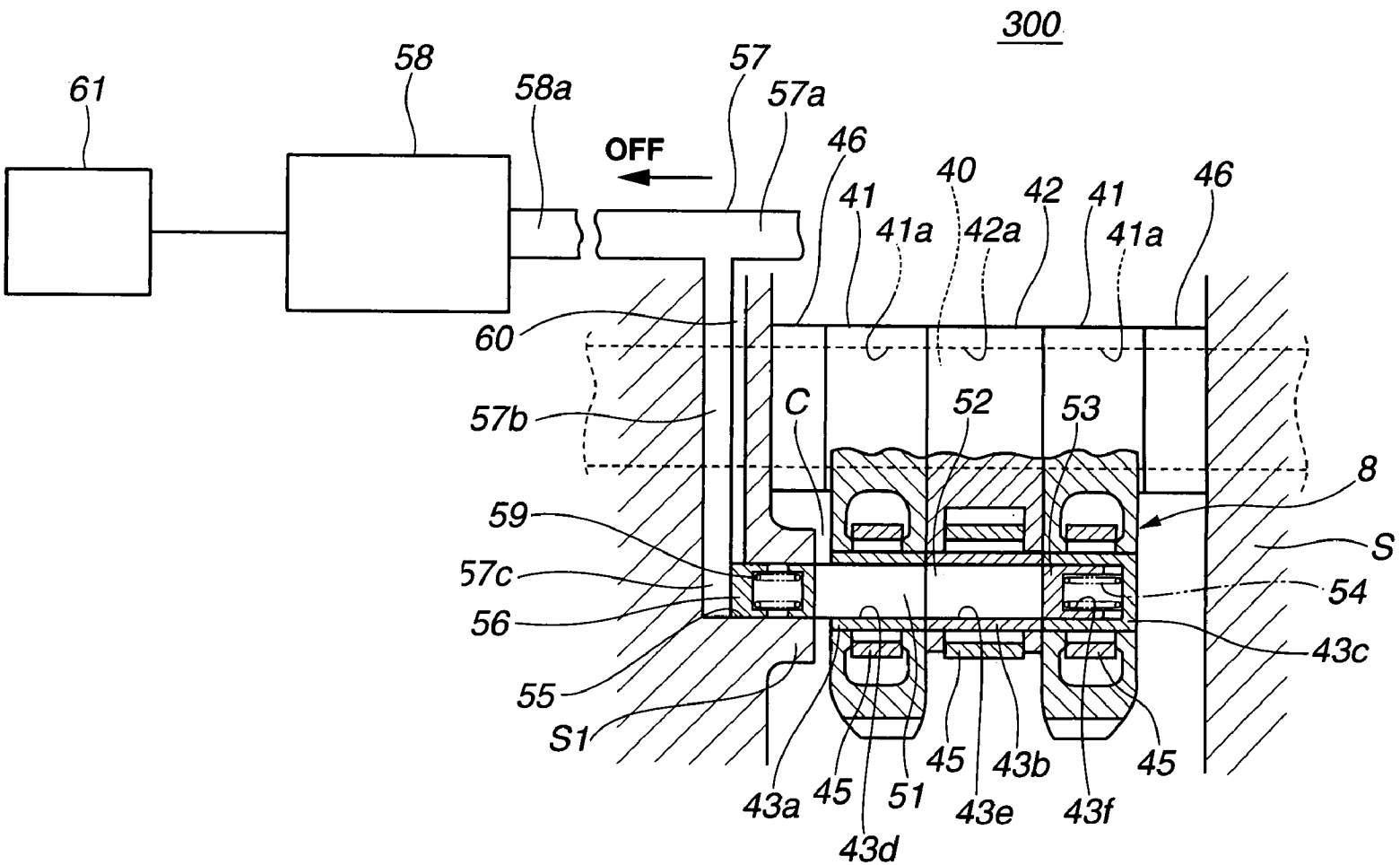
FIG. 14 is a sectional view of the essential portion of the actuation device of the third embodiment, showing one operation condition assumed by the valve actuation device.

As is seen from FIG. 14, first rocker arms 41 and 41 and second rocker arm 42 are provided at their leading end portions with respective bores (no numerals) that receive therein respective rollers 45 through first, second and third roller shafts 43*a*, 43*b* and 43*c* and respective needle bearings 44.

Figure 12:
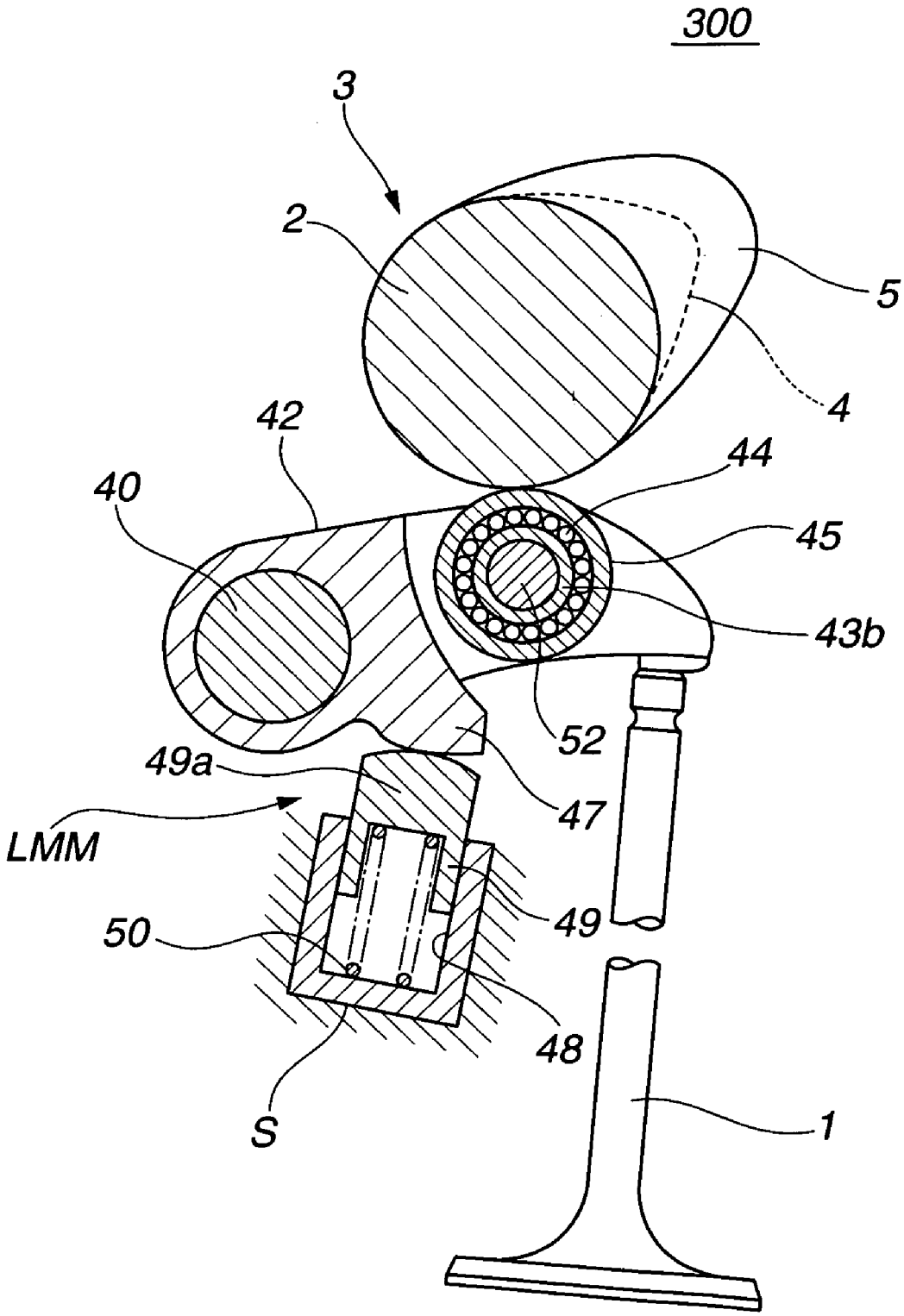
FIG. 12 is a sectional view of an essential portion of a valve actuation device of a third embodiment of the present invention.

The detail of the arrangement of the rollers 45 in respective bores will be understood from FIG. 12 that shows the arrangement of the roller 45 in second rocker arm 42.

As will be understood from FIGS. 12 and 13, the respective rollers 45 are operatively put on first cams 4 and 4 and second cam 5.

More specifically, as will be seen from FIG. 13, roller 45 on the left first rocker arm 41 as viewed in this drawing is put on the left first cam 4, roller 45 on the second rocker arm 42 is put on second cam 5 and roller 45 on the right first rocker arm 41 is put on the right first cam 4.

As is understood from FIG. 12, each roller shaft 43*a*, 43*b* or 43*c* is of a cylindrical hollow member, and as is seen from FIG. 14, each roller shaft is tightly received in aligned circular openings defined by the corresponding rocker arm 41, 41 or 42.

For the reasons that will be apparent hereinafter, the cylindrical hollow roller shafts 43*a*, 43*b* and 43*c* become aligned when first rocker arms 41 and 41 and second rocker arm 42 assume their given angular positions.

As is seen from FIG. 14, the roller shaft 43*c* for the right first rocker arm 41 has a right end closed. This means that the roller shaft 43*c* is a bottomed cylindrical roller shaft.

As is seen from FIGS. 13 and 14, annular spacers 46 and 46 are tightly mounted on rocker shaft 40 in a manner to put therebetween the three rocker arms 41, 41 and 42. With these spacers 46 and 46, positioning of the rocker arms 41, 41 and 42 relative to rocker shaft 40 is assured.

As is seen from FIG. 12, between second rocker arm 42 and cylinder head S, there is arranged a lost motion mechanism LMM by which second rocker arm 42 is subjected to a lost motion upon canceling of a coupling between second rocker arm 42 and each of first rocker arms 41 and 41.

Lost motion mechanism LMM comprises a round projection 47 formed on a middle lower part of second rocker arm 42, a cylindrical bore 48 of a case set in cylinder head S, a plunger 49 slidably received in cylindrical bore 48 and having a round head 49*a* contactable with round projection 47 of second rocker arm 42, and a lost motion spring 50 compressed between a bottom of cylindrical bore 48 and plunger 49 thereby to bias plunger 49 upward, that is, toward round projection 47.

Figure 15:
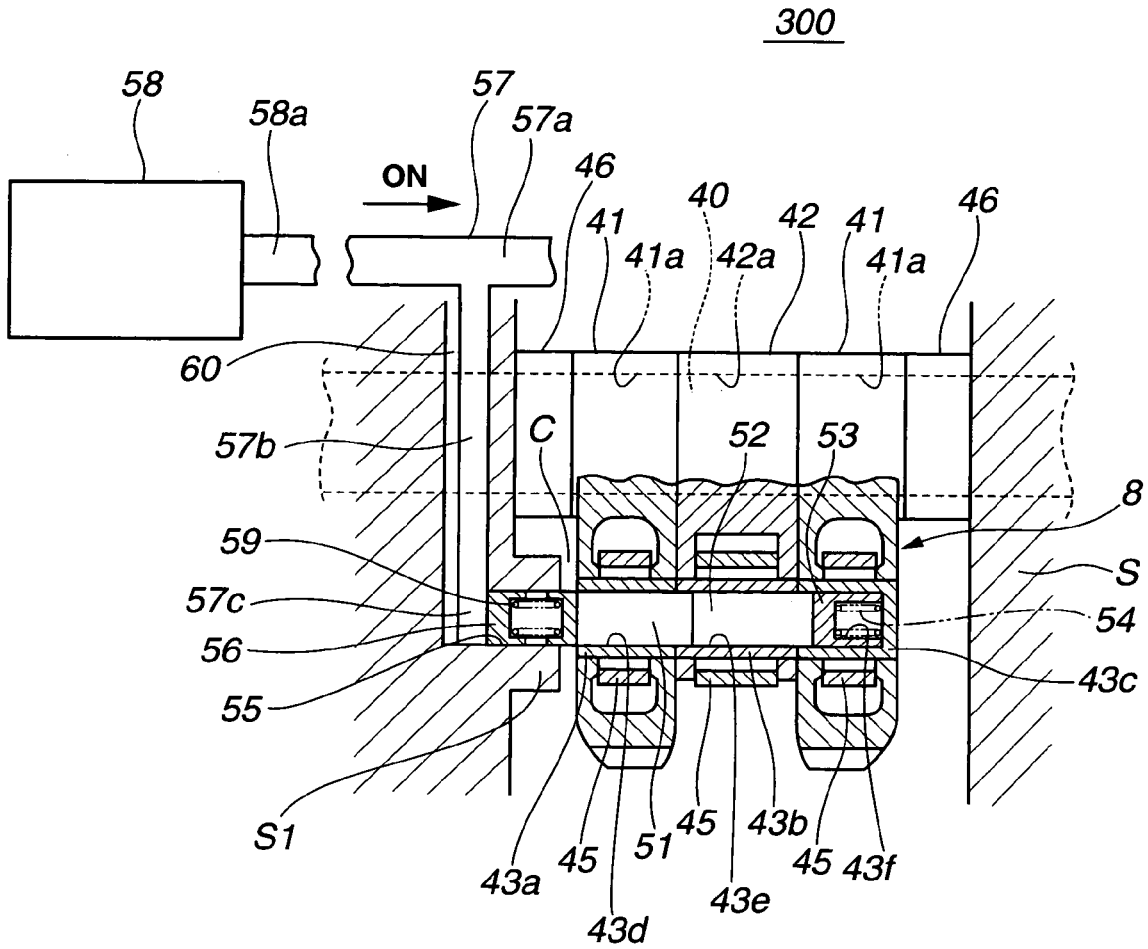
FIG. 15 is a view similar to FIG. 14, but showing another operation condition assumed by the valve actuation device.
Figure 16:
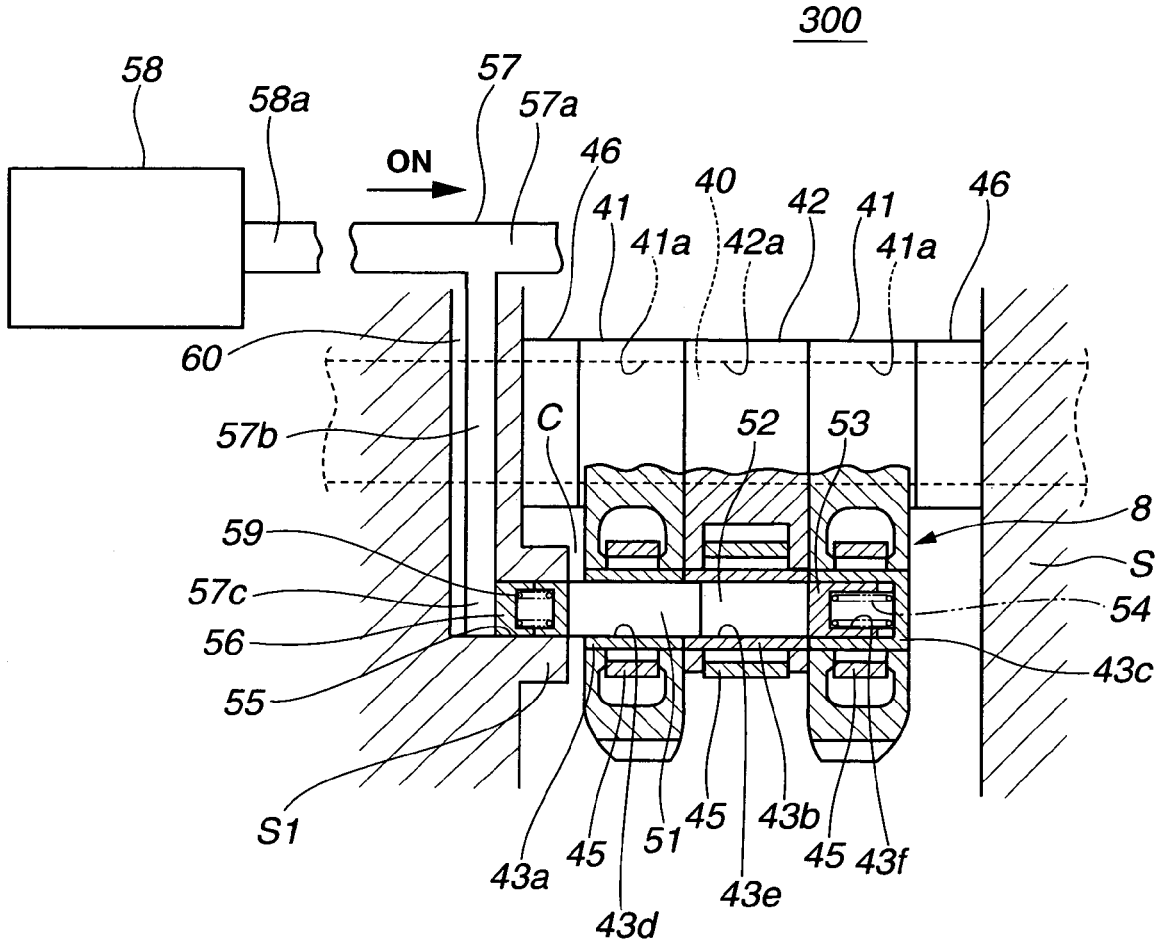
FIG. 16 is a view also similar to FIG. 14, but showing still another operation condition assumed by the valve actuation device.

As is seen from FIGS. 14 to 16, coupling mechanism 8 employed in this third embodiment 300 comprises first, second and third engaging pins 51, 52 and 53 that are slidably received in cylindrical hollow roller shafts 43*a*, 43*b* and 43*c*. In an after-mentioned predetermined condition, first, second and third engaging pins 51, 52 and 53 are neatly received in cylindrical hollow roller shafts 43*a*, 43*b* and 43*c* respectively as is seen in FIG. 14.

As is seen from FIG. 14, coupling mechanism 8 further comprises a return spring 54 that is compressed between third engaging pin 53 and the bottom of the right roller shaft 43*c*. Thus, in the illustrated condition of two first rocker arms 41 and 41 and second rocker arm 42 where the respective hollow roller shafts 43*a*, 43*b* and 43*c* are aligned, the three pins 53, 52 and 51 are biased leftward due to the biasing force of return spring 54.

Coupling mechanism 8 further comprises an electric actuating mechanism that, upon energization thereof, pushes the three pins 51, 52 and 53 rightward against the biasing force of return spring 54.

As shown, first engaging pin 51 is slightly longer than the length of the corresponding hollow roller shaft 43*a*, and second engaging pin 52 is substantially equal in length to the length of the corresponding hollow roller shaft 43*b*. While, the length of third engaging pin 53 is somewhat shorter that the length of the corresponding hollow roller shaft 43*c*. First and second engaging pins 51 and 52 are solid cylindrical members, while third engaging pin 53 has a cylindrical bore or recess. First, second and third engaging pins 51, 52 and 53 are permitted to move in an axial direction by about 2 to 3 mm.

As is understood from FIG. 14, the electric actuating mechanism comprises a cylindrical bore 55 that is formed in a projected portion S1 of cylinder head S at such a position as to mate with a cylindrical bore 43*d* of first roller shaft 43*a*, a pressing pin 56 that is slidably received in cylindrical bore 55 and contactable with a left end of first engaging pin 51, a moving rod 57 that directly moves pressing pin 56 in cylindrical bore 55, an electromagnetic actuator 58 that actuates moving rod 57 with an electric power, and a control unit 61 that controls operation of electric actuator 58.

As is seen from FIG. 14, between a front surface of the projected portion S1 of the cylinder head S and a left surface of first rocker arm 41, there is defined a predetermined clearance C which is for example 2 to 3 mm.

As is seen from FIG. 14, when first rocker arm 41 takes a given position as shown in the drawing, cylindrical bore 43*d* of first roller shaft 43*a* held by the arm 41 coincides with the bore 55 of projected portion S1 of cylinder head S. Under this condition, first engaging pin 51 is engageable with pressing pin 56 due to the force of return spring 54.

Pressing pin 56 is of a split structure comprising two elements and a spring 59 compressed between the two elements. Usually, as is seen from FIG. 14, the two elements are kept separated from each other due to the force of spring 59.

Moving rod 57 comprises a main rod part 57*a* that is connected to an output shaft 58*a* of electromagnetic actuator 58 and a sub-rod part 57*b* that is connected to main rod part 57*a* to move therewith. Sub-rod part 57*b* is movably received in a bore 60 formed in cylinder head S. Bore 60 is so sized as to permit a certain movement of sub-rod part 57*b* in a left and right direction in the drawing (FIG. 14). As shown, sub-rod part 57*b* has a leading end 57*c* that is contactable with pressing pin 56.

It is to be noted that the leftward and rightward moved distance of sub-rod part 57*b* is about 2 to 3 mm that is equal to the above-mentioned clearance C.

Accordingly, when moving rod 57 assumes its leftmost position as shown in FIG. 14, pressing pin 56 takes its leftmost position in cylindrical bore 55 of cylinder head S.

Although not well shown in the drawing, under this condition, a right end of pressing pin 56 is slightly projected from the bore 55.

Furthermore, under this condition, a left end of first engaging pin 51, that is slightly projected leftward from the bore 43*d* of first roller shaft 43*a*, is in contact with the slightly projected right end of pressing pin 56, and at the same time, second and third engaging pins 52 and 53 are respectively and neatly received in cylindrical bores 43*e* and 43*f* of corresponding second and third roller shafts 43*b* and 43*c* without a free axial movement thereof permitted.

Electromagnetic actuator 58 comprises a stationary core, a movable core that is moved in one direction when stationary core is energized and a biasing spring that biases the movable core in the other direction. The movable core is connected to the above-mentioned output shaft 58*a* to move therewith.

Control unit 61 is substantially the same as control unit 28 employed in the above-mentioned first embodiment 100. That is, in accordance with the operation condition of the associated internal combustion engine, control unit 61 controls electromagnetic actuator 58 in ON/OFF manner.

In the following, operation of the third embodiment 300 will be described.

When the engine is in an idling condition, control unit 61 de-energizes electromagnetic actuator 58 thereby to cause moving rod 57 to take its leftmost position as shown in FIG. 14. In this case, first, second and third engaging pins 51, 52 and 53 are neatly received in bores 43*d*, 43*e* and 43*f* of the respective roller shafts 43*a*, 43*b* and 43*c*. For this neat arrangement of the pins 51, 52 and 53, a biasing force of return spring 54 is used.

Under this condition, all of two first rocker arms 41 and 41 and second rocker arm 42 are free, and thus all of them are permitted to pivot free about rocker shaft 40. That is, two first rocker arms 41 and 41 and single second rocker arm 42 are permitted to pivot freely and independently in accordance with the cam profiles of two first cams 4 and 4 and second cam 5.

It is to be noted that under this condition, second rocker arm 42 is not coupled with any of two first rocker arms 41 and 41. That is, the pivoting movement of second rocker arm 42 is not transmitted to any of first rocker arms 41 and 41.

Thus, under this condition, two first rocker arms 41 and 41 are forced to swing having rollers 45 and 45 thereof operatively put on respective first cams 5 and 5. Thus, the lift degree and working angle of intake valves 1 and 1 are small, which is suitable for the idling condition of the engine.

Under this condition, second rocker arm 42 is forced to swing by second cam 5. Due to provision of the lost most mechanism LMM (see FIG. 12), the pivoting of second rocker arm 42 is subjected to a lost motion.

When the engine becomes to run at a higher speed, control unit 61 energizes electromagnetic actuator 58 thereby to cause moving rod 57 to take its rightmost position as shown in FIG. 16. Upon this, pressing pin 56 is compressed to produce and keep a certain biasing power. That is, upon this, there is still a condition wherein repeated contact between the right end of pressing pin 55 and left end of first engaging pin 51 is made.

When, upon running of respective rollers 45 of the three rocker arms 41, 42 and 41 on the base circle zones of the cam profiles of first and second cams 4, 4 and 5, first, second and third roller shafts 43*a*, 43*b* and 43*c* of the three rocker arms 41, 42 and 41 become aligned instantaneously with the cylindrical bore 55 of cylinder head S, the biasing power stored by pressing pin 56 presses and thus moves first, second and third engaging pins 51, 52 and 53 rightward in the aligned bores 43*d*, 43*e* and 43*f* of the roller shafts 43*a*, 43*b* and 43*c* against the force of return spring 54. With this, as is shown in FIG. 15, first engaging pin 51 takes a shifted position to couple the left first rocker arm 41 with second rocker arm 42, and second engaging pin 52 takes a shifted position to couple second rocker arm 42 with the right first rocker arm 41, and third engaging pin 53 is fully received in third roller shaft 43*c* while being contracted.

That is, under this condition, all of the three rocker arms 41, 42 and 41 are coupled to constitute a single structure. Thus, two first rocker arms 41 and 41 are forced to swing having roller 45 of second rocker arm 42 operatively put on second cam 4. Thus, the lift degree and working angle of intake valves 1 and 2 become large, which is suitable the higher speed operation of the engine.

As is described hereinabove, also in this third embodiment 300, the ON/OFF switching of coupling mechanism 8 is carried out by electromagnetic actuator 58 controlled by control unit 61. Accordingly, the various advantages of the above-mentioned first and second embodiments 100 and 200 are equally enjoyed by the third embodiment 300. Furthermore, in this third embodiment 300, simple and compact construction is achieved due to reduction in number of parts. Furthermore, in this embodiment, two first rocker arms 41 and 41 are mutually independently operated, and thus, the two intake valves 1 and 2 are able to have different lift characteristics.

Figure 17:
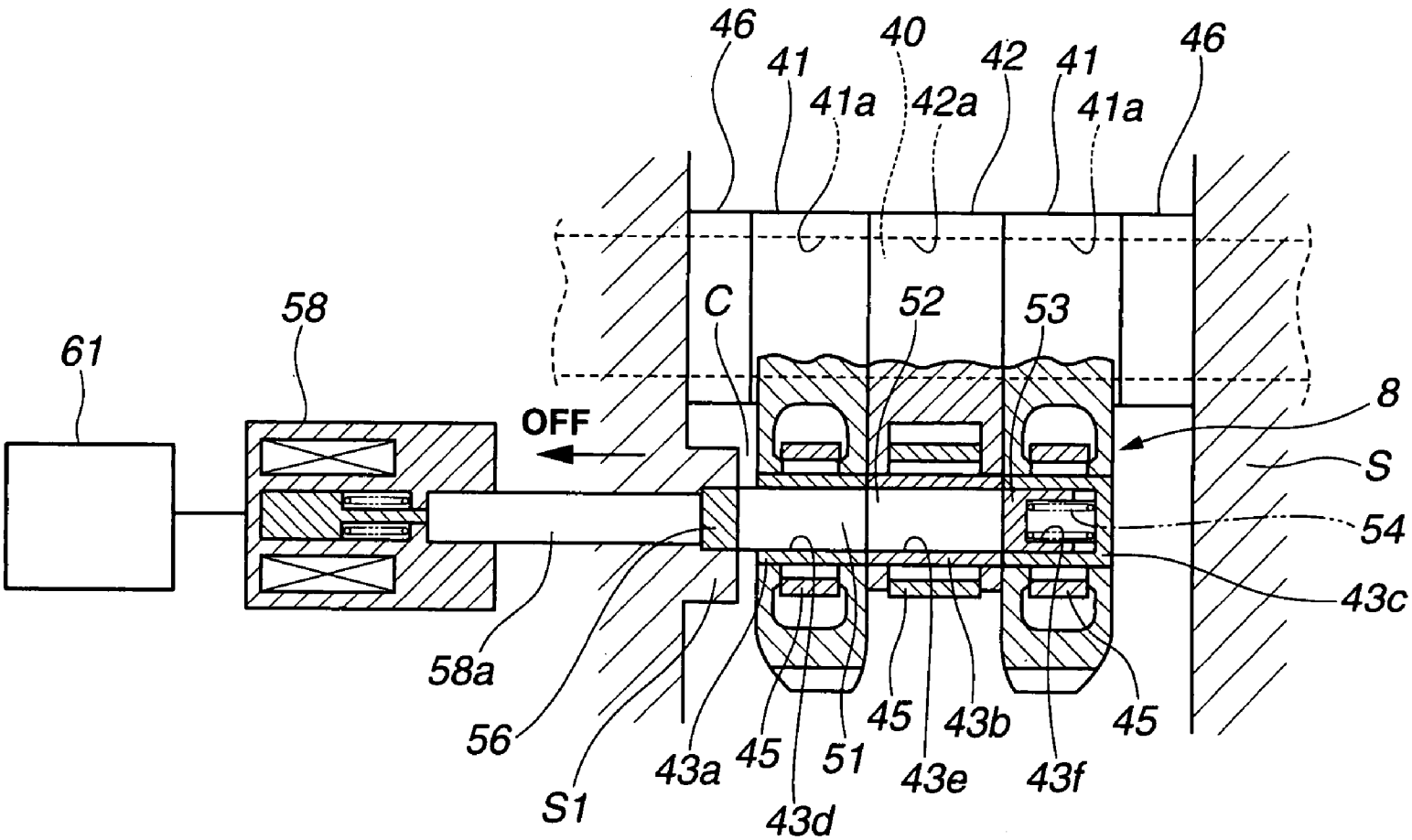
FIG. 17 is a view similar to FIG. 14, but showing a modification of the third embodiment wherein an arrangement of an electromagnetic actuator is changed.

Referring to FIG. 17, there is shown a valve actuation device 300' of an internal combustion engine, which is a modification of the above-mentioned third embodiment 300 of the present invention.

In this modification 300', the electric actuating mechanism is much simplified as compared with that of the third embodiment 300.

That is, in this modification 300', output shaft 58*a* of electromagnetic actuator 58 directly contacts pressing pin 56 without usage of the above-mentioned moving rod 57. Thus, in this modification, much simplified construction is achieved.

In the foregoing description, three embodiments 100, 200 and 300 and one modification 300' are described in detail.

If desired, the following modifications may be further employed in the present invention.

For some of cylinders of the internal combustion engine, there may be provided a valve actuation device in which the first cams 4 and 4 have no lobe portion. Thus, under a lower speed condition of the engine wherein the sub-rocker arm is not coupled to the main rocker arm, the intake valves do not operate.

In the above-mentioned embodiments, first cams 4 and 4 are designed suitable for the idling condition of the engine, and second cam 5 is designed suitable for the normal speed operation of the engine. However, if desired, first cams 4 and 4 may be designed suitable for a low to middle speed operation (viz., 1,500 rpm to 4,000 rpm) and second cam 5 may be designed suitable for a high speed operation (viz., above 4,000 rpm).

In the above-mentioned first and second embodiments 100 and 200, plunger 20 or 35 (see, FIGS. 4 and 9) is actuated by control cam 22 formed on control shaft 21. However, if desired, rocker shaft 9 may be used in place of control shaft 21. That is, in this case, rocker shaft 9 is arranged rotatable and formed with control cam 22.

The entire contents of Japanese Patent Application 2005-178955 filed Jun. 20, 2005 and Japanese Patent Application 2006-124956 filed Apr. 28, 2006 are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. A valve actuation device of an internal combustion engine, comprising:

a cam shaft having thereon at least first and second cams that are different in profile;

a first rocker arm that is in contact with the first cam to be swung, the first rocker arm being adapted to actuate an engine valve;

a second rocker arm that is in contact with the second cam to be swung;

a coupling mechanism that selectively couples and uncouples the first and second rocker arms; and an electric actuating mechanism that actuates the coupling mechanism with an electric power for the selective coupling and uncoupling, wherein the coupling mechanism comprises:

a control shaft, having an axis, that is rotated about its axis by the electric actuating mechanism;

a control cam integrally formed on the control shaft;

a plunger that is axially moved with one end thereof slidably contacting the control cam; and a lock mechanism that induces a mutually locked condition between the first and second rocker arms when the plunger is moved axially in one direction and a mutually unlocked condition between the first and second rocker arms when the plunger is moved axially in the other direction.

2. A valve actuation device as claimed in claim 1, in which the lock mechanism comprises:

a shaft through which the second rocker arm is pivotally held by the first rocker arm;

a lever member pivotally held by the first rocker arm, the lever member having a first end contacting a first end of the plunger;

a first engaging portion provided by a second end of the lever member; and a second engaging portion provided by the second rocker arm, wherein in response to axial movement of the plunger, the lever member is forced to pivot in a manner to selectively induce engaged and disengaged conditions between the first and second engaging portions.

3. A valve actuation device as claimed in claim 2, in which the plunger comprises:

an outer element that is in contact with the first engaging portion;

an inner element that is in contact with the control cam; and a spring compressed between the outer and inner elements.

4. A valve actuation device as claimed in claim 2, in which the plunger is slidably received in a bore formed in the first rocker arm.

5. A valve actuation device as claimed in claim 2, further comprising a lost motion mechanism through which the second rocker arm is subjected to a lost motion when a coupled condition between the first and second rocker arms is canceled.

6. A valve actuation device as claimed in claim 1, in which the first rocker arm is formed with two rocker arm portions for actuating two intake valves of the engine.

7. A valve actuation device as claimed in claim 1, in which the electric actuating mechanism comprises:

an electric motor;

a speed reduction gear operatively interposed between an output member of the electric motor and the control shaft to transmit a torque of the electric motor to the control shaft with a reduced speed; and a control unit that controls operation of the electric motor in accordance with an operation condition of the engine.

8. A valve actuation device as claimed in claim 1, in which the control shaft is rotatably received in a hollow rocker shaft by which the first rocker arm is swingably held.

9. A valve actuation device as claimed in claim 1, in which the coupling mechanism comprises:

a first cylindrical bore defined in the first rocker arm;

a second cylindrical bore defined in the second rocker arm, the second cylindrical bore being in alignment with the first cylindrical bore when the first and second rocker arms assume predetermined angular positions;

an engaging pin slidably received in the first cylindrical bore; and a pressing pin that is axially moved by the electric actuating mechanism in a direction to press and move the engaging pin to a position where the engaging pin extends between the first and second cylindrical bores.

10. A valve actuation device as claimed in claim 9, in which the electric actuating mechanism comprises:

an electromagnetic actuator that moves the pressing pin axially in one and the other directions in response to energization and deenergization of the electromagnetic actuator; and a control unit that controls the operation of the electromagnetic actuator in accordance with an operation condition of the engine.

11. A valve actuation device as claimed in claim 10, further comprising a movement transmitter through which an axial movement of the actuator is transmitted to the pressing pin.

12. A valve actuation device as claimed in claim 11, in which the movement transmitter comprises:

a main rod part axially moved by an output shaft of the electromagnetic actuator; and a sub-rod part connected to the main rod part to move therewith, the sub-rod part having a leading end that is contactable with the pressing pin.

13. A valve actuation device as claimed in claim 11, in which the movement transmitter comprises an output shaft of the electromagnetic actuator, the output shaft being axially movable and having a leading end contactable with the pressing pin.

14. A valve actuation device as claimed in claim 11, in which the pressing pin comprises:

two elements, one of which is in contact with the engaging pin and another of which is in contact with a moving rod; and a spring compressed between the two elements.

15. A valve actuation device as claimed in claim 1, in which the second cam on the cam shaft is shaped to provide the engine valve with a lift characteristic that is higher than a lift characteristic provided by the first cam.

16. A valve actuation device of an internal combustion engine, the engine having two intake valves for each cylinder, the valve actuation device comprising:

a cam shaft having thereon two first cams and a second cam that is different in profile from the two first cams;

a first rocker arm provided with two arm portions that are in contact with the two first cams to induce a swing movement of the first rocker arm, the two arm portions being adapted to actuate the two intake valves respectively;

a second rocker arm that is pivotally held by the first rocker arm and in contact with the second cam to be swung;

a coupling mechanism that selectively takes an ON condition wherein the first and second rocker arms are coupled and an OFF condition wherein the first and second rocker arms are uncoupled; and an electric actuating mechanism that actuates the coupling mechanism with an electric power to include the ON and OFF conditions of the coupling mechanism selectively, wherein the coupling mechanism comprises:

a control shaft having an axis and that is rotated about its axis by the electric actuating mechanism;

a control cam integrally formed on the control shaft;

a plunger that is axially moved with one end thereof slidably contacting with the control cam; and a lock mechanism that induces a mutually locked condition between the first and second rocker arms when the plunger is moved axially in one direction and a mutually unlocked condition between the first and second rocker arms when the plunger is moved axially in the other direction.

17. A valve actuation device of an internal combustion engine, the engine having two intake valves for each cylinder, the valve actuating device comprising:

a cam shaft having thereon at least first and second cams that are different in profile;

a rocker shaft;

two first rocker arms pivotally held by the rocker shaft and actuating the two intake valves respectively, wherein at least one of the two first rocker arms are in contact with the first cam to be swung;

a second rocker arm pivotally held by the rocker shaft at a position between the two first rocker arms, wherein the second rocker arm is in contact with the second cam to be swung;

a coupling mechanism that selectively takes an ON condition wherein the two first rocker arms and the second rocker arm are coupled and an OFF condition wherein the two first rocker arms and the second rocker arm are uncoupled; and an electric actuating mechanism that actuates the coupling mechanism with an electric power to induce the ON and OFF conditions of the coupling mechanism selectively, wherein the coupling mechanism comprises:

a control shaft that is rotated about its axis by the electric actuating mechanism;

a control cam integrally formed on the control shaft;

a plunger that is axially moved with one end thereof slidably contacting with the control cam; and a lock mechanism that induces a mutually locked condition between the first and second rocker arms when the plunger is moved axially in one direction and a mutually unlocked condition between the first and second rocker arms when the plunger is moved axially in the other direction.

18. A valve actuation device as claimed in claim 17, in which the coupling mechanism comprises:

first and third cylindrical bores defined in the two first rocker arms respectively;

a second cylindrical bore defined in the second rocker arm, the second cylindrical bore being in alignment with the first and third cylindrical bores when the two first rocker arms and the second rocker arm assume predetermined angular positions;

first and second engaging pins slidably received in the first and second cylindrical bores respectively; and a pressing pin that is axially moved by the electric actuating mechanism in a direction to press and move the first and second engaging pins to a position where the first engaging pin extends between the first and second cylindrical bores and the second engaging pin extends between the second and third cylindrical bores.

19. A valve actuation device as claimed in claim 18, in which a biasing pin is received in the third cylindrical bore in a manner to bias the first and second engaging pins against the pressing pin.

* * * * *